US011612776B2

(12) United States Patent
Williams et al.

(10) Patent No.: US 11,612,776 B2
(45) Date of Patent: Mar. 28, 2023

(54) INTEGRATED FLUID CONTROL VALVE AND VALVE ACTUATOR ASSEMBLY

(71) Applicant: Tyco Fire Products LP, Lansdale, PA (US)

(72) Inventors: James O. Williams, Marlborough, MA (US); Su Yang, Providence, RI (US)

(73) Assignee: Tyco Fire Products LP, Lansdale, PA (US)

( * ) Notice: Subject to any disclaimer, the term of this patent is extended or adjusted under 35 U.S.C. 154(b) by 435 days.

(21) Appl. No.: 16/678,137

(22) Filed: Nov. 8, 2019

(65) Prior Publication Data

US 2020/0069985 A1 Mar. 5, 2020

Related U.S. Application Data

(63) Continuation of application No. 15/569,159, filed as application No. PCT/US2016/031012 on May 5, 2016, now Pat. No. 10,471,287.

(60) Provisional application No. 62/157,867, filed on May 6, 2015.

(51) Int. Cl.

| | |
|---|---|
| ***A62C 35/68*** | (2006.01) |
| ***A62C 35/60*** | (2006.01) |
| ***A62C 35/64*** | (2006.01) |
| ***A62C 35/62*** | (2006.01) |

(52) U.S. Cl.

CPC ..... *A62C 35/68* (2013.01); *A62C 35/60* (2013.01); *A62C 35/605* (2013.01); *A62C 35/62* (2013.01); *A62C 35/645* (2013.01)

(58) Field of Classification Search

CPC ..... A62C 35/68; A62C 35/60; A62C 35/605; A62C 35/62; A62C 35/645

USPC ..... 169/20, 22

See application file for complete search history.

(56) References Cited

U.S. PATENT DOCUMENTS

| | | | |
|---|---|---|---|
| 3,220,483 | A | 11/1965 | Hoevenaar |
| 3,719,343 | A | 3/1973 | Werra |
| 3,788,400 | A | 1/1974 | Tufts |
| 4,226,259 | A | 10/1980 | Szekely et al. |
| 6,209,654 | B1 | 4/2001 | Curless |

(Continued)

FOREIGN PATENT DOCUMENTS

| | | |
|---|---|---|
| CN | 2727521 Y | 9/2005 |
| CN | 201159301 | 12/2008 |

(Continued)

*Primary Examiner* — Christopher S Kim

(74) *Attorney, Agent, or Firm* — Foley & Lardner LLP

(57) ABSTRACT

Systems and methods of an integrated fluid control valve and valve actuator assembly are provided. The assembly includes a pressure operated fluid control valve for controlling the flow of liquid from a liquid supply piping system into a sprinkler piping system of a fire protection system when transitioning the fire protection system from a standby state to an actuated state. The control valve defines a valve chamber for holding a pressurized fluid to prevent the flow of fluid through the control valve. A valve actuator is coupled to the fluid control valve housing for setting of the fluid control valve in an unactuated ready state and for operating the fluid control valve automatically and/or manually. The assembly has a common supply port to supply fluid to the control valve and the actuator and a common discharge port connected to multiple devices that can place the system in an actuated state.

9 Claims, 12 Drawing Sheets

(56) References Cited

U.S. PATENT DOCUMENTS

| | | | | |
|---|---|---|---|---|
| 6,293,348 | B1 | 9/2001 | Reilly | |
| 7,240,740 | B2 | 7/2007 | Reilly et al. | |
| 8,727,029 | B2 * | 5/2014 | Feenstra ..... | A62C 37/00 169/17 |
| 9,164,516 | B2 | 10/2015 | Wheater | |
| 2010/0071776 | A1 | 3/2010 | Ringer et al. | |
| 2011/0056709 | A1 | 3/2011 | Feenstra | |
| 2013/0306333 | A1 | 11/2013 | Ringer et al. | |
| 2014/0182865 | A1 | 7/2014 | Ringer | |
| 2016/0279454 | A1 | 9/2016 | Ringer et al. | |

FOREIGN PATENT DOCUMENTS

| | | | |
|---|---|---|---|
| CN | 101446357 | A | 6/2009 |
| CN | 202370931 | | 8/2012 |
| CN | 102913675 | | 2/2013 |
| CN | 202812291 | U | 3/2013 |
| CN | 203329232 | U | 12/2013 |
| IL | 58417 | A | 10/1983 |
| JP | 2010-220848 | | 10/2010 |
| WO | WO-2015/066710 | A2 | 5/2015 |

* cited by examiner

INTEGRATED FLUID CONTROL VALVE AND VALVE ACTUATOR ASSEMBLY

PRIORITY

The present application is a continuation of U.S. patent application Ser. No. 15/569,159, filed Oct. 25, 2017, which is a national phase of PCT Application No. PCT/US2016/031012 filed May 5, 2016, which claims the benefit of priority to U.S. Provisional Application No. 62/157,867 filed on May 6, 2015, each of which is incorporated herein by reference in its entirety.

TECHNICAL FIELD

This invention relates generally to a differential fluid control valve, and more specifically relates to a valve actuator for actuating a fluid control valve of a fire protection system.

BACKGROUND ART

An automatic sprinkler system is one of the most widely used devices for fire protection. These systems have sprinklers that are activated once the ambient temperature in an environment, such as a room or a building, exceeds a predetermined value. Once activated, the sprinklers distribute fire-extinguishing fluid, preferably water, in the room or building. A fire sprinkler system, depending on its specified configuration, is considered effective if it controls or suppresses a fire.

The sprinkler system can be provided with a water supply (e.g., a reservoir or a municipal water supply). Such supply may be separate from that used by a fire department. Regardless of the type of supply, the sprinkler system is provided with a main that enters the building to supply a riser. Connected at the riser are valves, meters, and, preferably, an alarm to sound when the system activates. Downstream of the riser, a usually horizontally disposed array of pipes extends throughout the fire compartment in the building. Other risers may feed distribution networks to systems in adjacent fire compartments. The sprinkler system can be provided in various configurations. In a wet-pipe system, used for example, in buildings having heated spaces for piping branch lines, all the system pipes contain a fire-fighting liquid, such as, water for immediate release through any sprinkler that is activated. In a dry-pipe system, used in for example, unheated areas, areas exposed to freezing, or areas where water leakage or unintended water discharge is normally undesirable or unacceptable such as, for example, a residential occupancy, the pipes, risers, and feed mains, branch lines and other distribution pipes of the fire protection system may contain a dry gas (air or nitrogen or mixtures thereof) under pressure when the system is in a stand-by or unactuated condition. A valve is used to separate the pipes that contain the water from the portions of the system that contain the dry gas. When heat from a fire activates a sprinkler, the gas escapes from the branch lines and the dry-pipe valve trips or actuates; water enters branch lines; and firefighting begins as the sprinkler distributes the water.

One type of fluid control valve used to separate the gas filled pipes and liquid filled pipes is a diaphragm-type or diaphragm style valve, such as that shown in U.S. Pat. No. 8,616,234, entitled "Fluid Control Valve Systems and Methods," or as shown in Tyco Fire Products published Data Sheet, TFP 1315 entitled, "Model DV-5 Deluge Valve, Diaphragm Style, 1.5 through 8 Inch (DN40 through DN 200) Deluge Systems—Dry Pilot Actuation." (March 2004), Tyco Fire Products published Data Sheet, TFP 1310 entitled "Model DV-5 Deluge Valve, Diaphragm Style, 1.5 through 8 Inch (DN40 through DN 200) Deluge Systems—Wet Pilot Actuation." (March 2004), Tyco Fire Products published Data Sheet, TFP 1320 entitled "Model DV-5 Deluge Valve, Diaphragm Style, 1.5 through 8 Inch (DN40 through DN 200) Deluge Systems—Electric Pilot Actuation." (March 2004), each of which is incorporated by reference in its entirety. To control the flow of fluid between the inlet and the outlet and the respective wet and dry portions of the system, the control valve uses an internal diaphragm member having a sealed position and an open position to control the flow of fluid through the valve so as to respectively prevent and permit the flow of fluid from the wet portion of the system to the dry portion of the system. The position of the diaphragm is controlled by fluid pressure acting on the internal diaphragm member. The fluid pressure is controlled by various components arranged to respond to system conditions.

Applicant's co-pending International Application No. PCT/US14/63925 (the '925 application," which is incorporated herein by reference in its entirety, discloses an integrated fluid control valve and valve actuator assembly. The valve actuator of the '925 application provides for a valve actuator with a multi-trim configuration that is not found in the prior art. Specifically, the '925 application provides for a base four-port actuator configuration and optional five and six port configurations. The base four-port actuator has a compact configuration that includes ports for performing various functions such as, e.g., a first port to provide fluid communication with the control valve, a second port to interface with one of a number of different trim packages that can be used to automatically trip (or open) the fluid control valve, a third port to drain the actuator and a fourth port to provide pressurized fluid to both the valve actuator and the control valve. The optional five- and six-port actuator configurations include the base four-port configuration and a fifth port that can be connected to a manual release device for manually tripping the fluid control valve. An optional sixth port can be included to add a pressure gauge. The inventive valve actuator configuration of the '925 application allows for a compact control valve/valve actuator assembly because the various functions for operating a control valve can be incorporated into a single valve actuator that can be mounted directly on the control valve.

In the '925 application, however, the addition of the manual release device means that the compactness of the four-port design is compromised in order to add the optional fifth port for the manual release device. In addition, the second and third ports are disposed along the same radial position on the valve actuator housing, and thus must be disposed offset to each other along a lengthwise direction on the actuator housing with respect to a central axis of the actuator. This means that, even in the four-port configuration, the length of the valve actuator must take into account two ports arranged adjacent to each other in a lengthwise direction. Further, the valve actuator in the '925 application includes a biasing member that is disposed inside the actuator such that an end of the biasing member circumscribes the first and second valve seats, which in turn circumscribe the first port. Thus, the width of the valve actuator must be large enough to accommodate the diameter of the biasing member, the diameter of the first and second valve seat assembly and the diameter of the first port. Accordingly, while the actuator of the '925 provides for an inventive compact design, additional reduction in complexity and size are possible with respect to the number of ports, the port arrangements and the internal configuration of the valve actuator.

Further limitations and disadvantages of conventional, traditional, and proposed approaches will become apparent to one skilled in the art, through comparison of such approaches with embodiments of the present invention as set forth in the remainder of the present disclosure with reference to the drawings.

DISCLOSURE OF INVENTION

Systems and methods of a preferred integrated fluid control valve and valve actuator assembly are provided. The preferred assembly includes a valve actuator that utilizes a minimum number of ports that are needed to reliably actuate the fluid control valve. In some embodiments, the preferred control valve includes four ports with a first port to communicate with the fluid control valve, a second port, which is a pilot port or control port, to communicate with both an automatic control device and a manual release device, a third port to communicate with a drain, and a fourth port to supply the fluid to the control portion of the valve actuator and fluid control valve. By having the second port connected to both the automatic control and the manual release device, both the number of ports on the valve actuator and the complexity of the actuator can be reduced when compared to the actuator configurations in the '925 application and/or the prior art. The preferred assembly has a common supply port to supply fluid to the control valve and the actuator and a common discharge port connected to multiple devices that can place the fire system in an actuated state, which minimizes the number of required valves and/or valve actuator ports in a typical fire system. In addition, the preferred integrated fluid control valve and valve actuator includes an assembly that allows for a valve and trim assembly that is standardized for multiple system configurations. In particular, this integrated assembly allows for the same fluid control valve and valve actuator assembly to be used for systems that utilize wet pilot actuation, dry pilot actuation, electric actuation, pneumatic actuation, and pneumatic/electric actuation. In order to utilize the integrated fluid control valve and valve actuator for the various systems, various actuation components are added to the integrated assembly.

The preferred integrated fluid control valve and valve actuator provides for an assembly that includes a fluid control valve having an inlet and an outlet disposed along an axis for controlling the flow of liquid from a liquid supply piping system into a sprinkler piping system when transitioning the fire protection system from a stand-by state to an actuated (or tripped) state. The control valve includes a valve housing that includes a valve chamber for holding a pressurized fluid to prevent the flow of fluid through the control valve. The preferred assembly includes a valve actuator including an actuator housing proximate to, preferably coupled to and more preferably secured to the valve housing.

In a preferred embodiment of a valve actuator, the housing has an interior surface which defines an internal chamber with a central axis. The valve actuator further includes a first actuator seat disposed along the interior surface of the housing circumscribed about the central axis and a second actuator seat disposed along the interior surface and circumscribed about the first actuator seat. The valve actuator further preferably includes a seal member having a sealed position, in which the seal member is engaged with the first actuator seat and the second actuator seat, and an open position, in which the seal member is axially spaced from the first and second actuator seats. The preferred valve actuator further preferably includes a first port that is proximate the first actuator seat and in fluid communication with the internal chamber. In a preferred assembly, a flow axis of the first port is coaxial with the central axis of the internal chamber. As used herein, unless otherwise expressly provided, a "port" includes a spatial volume defined by a channel, conduit or other passageway that provides for fluid communication between two or more areas, chambers or regions about or within a device or assembly. "Fluid communication" or "communication" as used herein, unless otherwise expressly provided, the passage of a liquid or gas between two or more areas, chambers, or regions of a device or assembly.

The preferred assembly further includes a second port in communication with the internal chamber and having a flow axis that is transverse to the central axis of the internal chamber. The preferred assembly also includes a third port in communication with the internal chamber and having a flow axis that is transverse to the central axis and the flow axis of the second port. That is, in some embodiments, the flow axis of the third port is offset in a radial direction from the flow axis of the second port. In such embodiments, the length of the valve actuator can be reduced when compared to configurations in the '925 application. Because the second and third ports of exemplary embodiments of this disclosure are offset in a radial direction with respect to each other, the centerlines of the second and third ports can be arranged closer to each other along the lengthwise direction on the actuator housing than if the second and third ports are arranged adjacent to each other at the same radial position on the actuator housing. While there can still be some offset of the centerlines of the second and third ports in the lengthwise direction, this offset is less than if the second and third ports are arranged next to each other along the same radial position. Accordingly, when compared to embodiments of the '925 application, exemplary embodiments of the valve actuator can have a shorter length and thus have a more compact valve configuration. The third port is preferably isolated from the first port and the second port when the sealing member is in the sealed position and in fluid communication with the first port and the second port when the sealing member is in the open position. A fourth port of the preferred actuator is in communication with the first port and in communication with the internal chamber. A flow axis of the fourth port is transverse to the central axis and to the flow axis of the third port. The fourth port is preferably isolated from the third port when the sealing member is in the sealed position, and in fluid communication with the third port when the sealing member is in the open position. Preferably, the flow axis of the second port is offset by approximately 90 degrees radially from the flow axis of third port. Preferably, the second port is offset by approximately 90 degrees from the third port and the third port is offset approximately 90 degrees from the fourth port.

The ports or portions thereof preferably define a direction of fluid communication or additionally or alternatively defines a direction or orientation in which the port or a portion thereof extends relative to line, point, axis, surface or other area of a device and/or assembly. To provide fluid communication, the preferred ports of the actuator and/or control valve assembly include, define and or integrate one or more connections. As used herein, "connection" is a portion and more preferably an end portion of a port, device or assembly to couple, secure, or join the port, device or assembly to another device, or assembly or ports, connections and/or chambers thereof. Preferred embodiments of a connection include known mechanical connections, such as for example threaded connections, quick-connect connections, fitted connections, soldered connections or welded connections. In a preferred embodiment of the assembly, the first port of the actuator preferably includes a first connection being disposed in a first direction toward the flow axis of the control valve, and the second and fourth connections are preferably disposed in a second direction transverse to the first direction. The third connection is preferably disposed in a third direction that is transverse to the first and second directions. The first connection preferably secures the actuator to the fluid control valve housing. In the preferred embodiment, the second connection is disposed at an opposed location on the housing from the fourth connection. Preferably, the third direction is offset in a radial direction from the second direction with respect to a central axis of the valve actuator. Preferably, the second direction is offset by approximately 90 degrees radially from the third direction.

The preferred assembly further provides an actuator housing that preferably includes an interior surface defining an internal chamber that controls the volume of pressurized fluid within a valve chamber of the control valve. The actuator further includes a housing having a first connection providing fluid communication between the valve chamber and the internal chamber. A second connection provides fluid communication with at least one control device. In some exemplary embodiments, the control device can be an automatic control device that senses a condition in the fluid system, a manual release device that is connected to a drain or any other type of device that can release fluid pressure from the internal chamber. Preferably, the second connection provides fluid communication to an automatic control device and a manual release device and preferably the automatic control device and the manual release device are connected to the second connection using a common connection, e.g., a T-connection. A third connection provides fluid communication with a drain. A fourth connection provides fluid communication with a fluid supply.

The preferred valve actuator further includes a first actuator seat disposed along the interior surface of the actuator housing and circumscribed about a central axis of the valve housing. The preferred valve actuator also includes a second actuator seat disposed along the interior surface of the housing and circumscribed about the first actuator seat. The preferred valve actuator further includes a seal or sealing member. The seal member defining a sealed position, in which the seal member is engaged with the first actuator seat and the second actuator seat, and defining an open position, in which the seal member is axially spaced from the first and second actuator seats. The preferred valve actuator includes at least one biasing member to bias the sealing member in the open position, and the at least one biasing member being disposed such that a radial distance from the central axis to an outermost portion of the at least one biasing member is less than or equal to a radial distance from the central axis to an inner portion of a seal boundary formed between the first actuator seat and the seal member when the seal member is in the sealed position.

In a preferred assembly, the first connection is preferably disposed in a first direction and the second and fourth connections are disposed in a second direction transverse to the first direction. The third connection is disposed in a third direction that is transverse to the first and second directions. When assembled, the first direction is preferably toward the longitudinal axis of the fluid control valve. The second connection is located at an opposed location on the housing from the fourth connection. In some embodiments, a fifth connection provides fluid communication with a pressure gauge. Preferably, the fifth connection is disposed in the third direction at an opposed location on the housing from the third connection. To reset the fluid control valve and valve actuator assembly to enter the stand-by state, a manual reset actuator is preferably aligned with the first connection. The preferred assembly further includes a housing that supports a drip funnel and ends of drain lines, and preferably disposed in the drip funnel are the ends of drain lines that are attached to the third connection, the automatic control device, and/or the manual release device.

The preferred assembly further includes a fluid control valve having an inlet and an outlet disposed along a valve axis for controlling the flow of a liquid from a liquid supply piping system into a sprinkler piping system when transitioning the fire protection system from a stand-by state to an actuated (or tripped) state. The control valve includes a valve housing that includes a valve chamber for holding a pressurized fluid to prevent the flow of fluid through the control valve. In some embodiments, a diaphragm forms a portion of the surface of the valve chamber. The control valve preferably includes a neutral chamber that is defined by the diaphragm. The assembly preferably includes an alarm system coupled to a connection that is in fluid communication with the neutral chamber. The preferred assembly includes a valve actuator including an actuator housing that is secured to the control valve housing.

In another embodiment, a method of operating a valve actuator is provided where the preferred valve actuator has a stand-by state defined by a sealing member being engaged with a first actuator seat and a second actuator seat formed along an internal surface of a housing of the valve actuator, and an actuated (or tripped) state defined by the sealing member being spaced from the first actuator seat and the second actuator seat. The method preferably includes establishing the stand-by state, which more particularly includes disposing the sealing member against the actuator seats. The preferred method establishing the stand-by state further includes providing fluid pressure from a common supply port to an actuator chamber on a first side of the sealing member and a port on the second side of the sealing member. The preferred method further preferably includes establishing the trip state, which particularly includes exposing the actuator chamber to an actuated automatic control device and/or an actuated manual control device via a common discharge port connected to the automatic control device and the manual release device, and placing the port on the second side of the sealing member in direct fluid communication with the actuator chamber. "Direct fluid communication" as used herein, unless otherwise expressly provided, means "fluid communication" without the liquid or gas passing through an intervening area, chamber, or region of a device or assembly. For example, while the port on the second side of the sealing member and the chamber of the valve actuator are in fluid communication even with the sealing member in the closed position via bores (discussed below) in the common supply port, the port on the second side of the sealing member and the actuator chamber will be in "direct fluid communication" when the sealing member is in the open position. The method establishing the trip state preferably further includes placing the actuator chamber in fluid communication with a drain.

The preferred method further includes providing the pressurized fluid from the common supply port to a chamber of a control valve. The method preferably further includes providing the pressurized fluid from the chamber of the control valve to the chamber of the valve actuator when the port on the second side of the sealing member is placed in direct fluid communication with the chamber of the valve actuator. The method establishing the trip state preferably further includes providing the pressurized fluid from the chamber of the valve actuator to the drain at a rate greater than the common supply port providing the pressurized fluid to the chamber of the valve actuator.

The preferred assembly provides an actuator housing that preferably includes an interior surface defining an internal chamber that controls the volume of pressurized fluid within the valve chamber of the control valve. The actuator housing further includes a first connection providing fluid communication between the valve chamber and the internal chamber. A second connection provides fluid communication preferably with devices that can include an automatic control device such as, e.g., an electric actuation device, a pneumatic actuation device or a combination of an electric actuation and pneumatic actuation device and/or a manual release device. A third connection provides fluid communication with a drain, and a fourth connection provides fluid communication with a fluid supply. Preferably, the first connection is disposed in a first direction along a central axis of the actuator housing and the second and fourth connections are disposed in a second direction transverse to the first direction. The second connection is disposed at an opposed location on the housing from the fourth connection. The third connection is disposed in a third direction that is transverse to the first and second directions. Preferably, the third direction is offset in a radial direction from the second direction with respect to a central axis of the valve actuator. Preferably, the second direction is offset by approximately 90 degrees radially from the third direction.

One preferred embodiment of the invention provides a preferred actuator for actuation of a control valve. The preferred actuator includes a housing having an interior surface defining an internal chamber with a central axis. A first actuator seat is disposed along the interior surface of the housing preferably circumscribed about the central axis, and a second actuator seat is disposed along the interior surface preferably circumscribed about the first actuator seat. A seal member defines a preferred sealed position, in which the seal member is engaged with the first actuator seat and the second actuator seat. The seal member further defines an open position, in which the seal member is axially spaced from the first and second actuator seats. The preferred valve actuator further includes a first port proximate the first actuator seat in communication with the internal chamber, a second port in communication with the internal chamber, a third port in communication with the internal chamber, and a fourth port in communication with the first port and in communication with the internal chamber. For the preferred actuator, the third port is isolated from the first port and the second port when the sealing member is in the sealed position; and when the sealing member is in the open position, the third port is in fluid communication with the first port and the second port. The fourth port is isolated from the third port when the sealing member is in the sealed position; and when the sealing member is in the open position, the fourth port is in fluid communication with the third port. Preferably, a flow axis of the first port is coaxial with the central axis and a flow axis of the second port is transverse to the central axis. Preferably, a flow axis of the third port is transverse to the central axis and to the flow axis of the second port, and a flow axis of the fourth port is transverse to the central axis and to the flow axis of the third port. Preferably, the flow axis of the third port is offset in a radial direction from the flow axis of the second port. Preferably, the second port is offset by approximately 90 degrees from the third port and the third port is offset approximately 90 degrees from the fourth port.

The preferred valve actuator alone or in the system may include one or more of the following features additionally or in the alternative. For example, one embodiment has at least one biasing member that is disposed between an interior surface of the first port and the seal member to bias the seal member toward the open position with the at least one biasing member. The first port can include a land portion that is disposed in the first port. The at least one biasing member can be a spring that comprises at least one coil spring having a first end engaged with the land portion of the first port. The second end of the coil spring is preferably engaged with a portion of the seal member that faces the first actuator seat. In a preferred embodiment, each of the first and second actuator seats are preferably substantially circular, the first actuator seat having a first diameter and the second actuator seat having a second diameter, the first diameter being less than the second diameter. By disposing the biasing member within the first port, the width of the valve actuator can be reduced when compared to the width of the actuator in the '925 application, which has a biasing member that circumscribes the actuator seat assembly. Thus, exemplary embodiments of the valve actuator can be more compact than related art and/or prior art valve actuators.

Preferably, the seal member is centered about the central axis in the open position and in the closed position. Moreover, the seal member is preferably supported in the open position within the actuator housing exclusively by a frictional engagement with the at least one biasing member such that the seal member is not supported by any other actuator structure. The seal member, when in a sealed position with the first and second actuator seats, preferably defines an annular void, which is even more preferably in communication with the third or drain port of the preferred actuator via an opening, e.g., an oblong opening, in a surface between the first and second actuator seats. The seal member preferably comprises a cylindrical member or assembly, having a distal side opposed to the first and second actuator seats and a proximal side opposite the distal side. The distal side of the seal member preferably includes a seal that engages the first actuator seat and the second actuator seat in the sealed position. Preferably, the first port is a valve chamber port, the second port is a pilot port and the third port defines a drain port. The actuator in another embodiment, preferably includes a plunger member to engage the sealing member to dispose the sealing surface against the first and second actuator seats.

In another embodiment, a method of operating an valve actuator is provided where the preferred valve actuator has a stand-by state defined by the sealing member being engaged with first actuator seat and a second actuator seat formed along an internal surface of a housing of the valve actuator and an actuated state (or tripped state) defined by the sealing member being spaced from the first actuator seat and the second actuator seat. The method preferably includes establishing the stand-by state, which more particularly includes locating the sealing member against the actuator seats. The method establishing the stand-by state preferably further includes providing fluid pressure from a common supply port to an actuator chamber on a first side of the sealing member and to a port on the second side of the sealing member. The preferred method further preferably includes establishing a trip state, which particularly includes exposing the actuator chamber to an actuated automatic control device and/or an actuated manual release device via a common discharge port connected to the automatic control device and the manual release device, and placing the common discharge port in fluid communication with the chamber. The method establishing the trip state preferably further includes placing the actuator chamber on the first side of the sealing member in fluid communication with a drain.

The preferred method further includes providing a pressurized fluid to a chamber of a control valve. The method preferably further includes providing a pressurized fluid from the chamber of the control valve to the chamber of the valve actuator when the chamber of the control valve is placed in direct fluid communication with the chamber of the valve actuator. The method establishing the trip state preferably further includes providing the pressurized fluid to a drain at a rate greater than a rate that the common supply port provides pressurized fluid to the chamber on the valve actuator.

The preferred assembly provides an actuator housing that preferably includes an interior surface defining an internal chamber that controls the volume of pressurized fluid within the valve chamber of the control valve. The actuator housing further includes a first connection providing fluid communication between the valve chamber and the internal chamber. A second connection provides fluid communication preferably with an automatic control device that can include, e.g., an electric actuation device, a pneumatic actuation device or a combination of an electric actuation and pneumatic actuation device and/or a manual release device. The third connection provides fluid communication with a drain, and the fourth connection provides fluid communication with a fluid supply. Preferably, the first connection is disposed in a first direction along a central axis of the valve actuator and the second and fourth connections are disposed in a second direction transverse to the first direction. The third connection is disposed in a third direction that is transverse to the first and second directions. The second connection is disposed at an opposed location on the housing from the fourth connection.

The preferred system valve actuator further includes a first port proximate the first actuator seat and coupled to the chamber of the control valve to provide fluid communication between the chamber of the control valve and the internal chamber of the actuator. A second port is preferably coupled to an automatic control device that monitors the status of the fire protection system and/or a manual release device and preferably to both the automatic control device and the manual release device via a common connection, e.g., a T-connection, with a third port and fourth port in communication with the internal chamber. The third port is preferably isolated from the first port and the second port when a sealing member is in a sealed position. The third port is preferably in fluid communication with the first port and second port when the sealing member is in an open position. The fourth port is preferably isolated from the third port when the sealing member is in the sealed position. The fourth port is preferably in fluid communication with the third port when the sealing member is in the open position. The fourth port provides fluid to the chamber of the control valve and the internal chamber of the valve actuator to maintain the sealing member in the sealed position and to fill the chamber of the control valve with pressurized fluid. Preferably, a flow axis of the first port is coaxial with a central axis of the internal chamber and a flow axis of the second port is transverse to the central axis. Preferably, a flow axis of the third port is transverse to the central axis and to the flow axis of the second port, and a flow axis of the fourth port is transverse to the central axis and to the flow axis of the third port. Preferably, the flow axis of the third port is offset in a radial direction from the flow axis of the second port. Preferably, the second port is offset by approximately 90 degrees from the third port and the third port is offset approximately 90 degrees from the fourth port. A control device can be connected to the second port and can be an automatic control device such as a wet pilot actuator, a dry pilot actuator, an electrical actuator, a pneumatic actuator, and combinations thereof and/or a manual release device. The sealing member can be manually reset to the sealed position. The preferred system valve actuator further includes a fifth port in communication with the internal chamber and the fifth port is coupled to a pressure gauge. Preferably, the first port is a valve chamber port, the second port is a pilot port or control port and the third port defines a drain port and is coupled to a drain.

Another preferred embodiment provides for a fire protection system having a stand-by state and an actuated (or tripped) state. The system preferably includes a liquid supply piping system for supplying a liquid under a liquid pressure, a sprinkler piping system being filled with a gas under a gas pressure in the stand-by state, and a fluid control valve for controlling a flow of the liquid from the liquid supply piping system into the sprinkler piping system upon transition of the fire protection system from the stand-by state to the actuated state, the control valve including a chamber for holding a pressurized fluid to prevent the flow of the liquid through the control valve. The system further preferably includes a valve actuator including a housing having an interior surface defining an internal chamber with a central axis. A first actuator seat is preferably disposed along the interior surface of the housing circumscribed about the central axis; and a second actuator seat is preferably disposed and circumscribed about the first actuator seat. A sealing member preferably defines a sealed position within the actuator with the sealing member engaged with the first actuator seat and the second actuator seat. The sealing member further defines an open position axially spaced from the first and second actuator seats.

A preferred embodiment of a fluid control valve is provided that includes a housing defining an inlet and an outlet disposed along a flow axis. The control valve housing defines a central valve axis perpendicular to and intersecting the flow axis to define a first plane. The flow axis defines a second plane perpendicular to the first plane with the flow axis defining the intersection of the first plane and the second plane. At least one port of the fluid control valve is disposed to one side of the second plane with the at least one port having a connection defining a central axis extending parallel to the second plane and perpendicular to the first plane. In one embodiment, the fluid control valve defines a valve chamber disposed to one side of the second plane opposite the side of the at least one port.

BRIEF DESCRIPTIONS OF THE DRAWINGS

The accompanying drawings, which are incorporated herein and constitute part of this specification, illustrate exemplary embodiments of the invention, and, together with the description given above, serve to explain the features of the invention.

MODE(S) FOR CARRYING OUT THE INVENTION

Figure 1A:
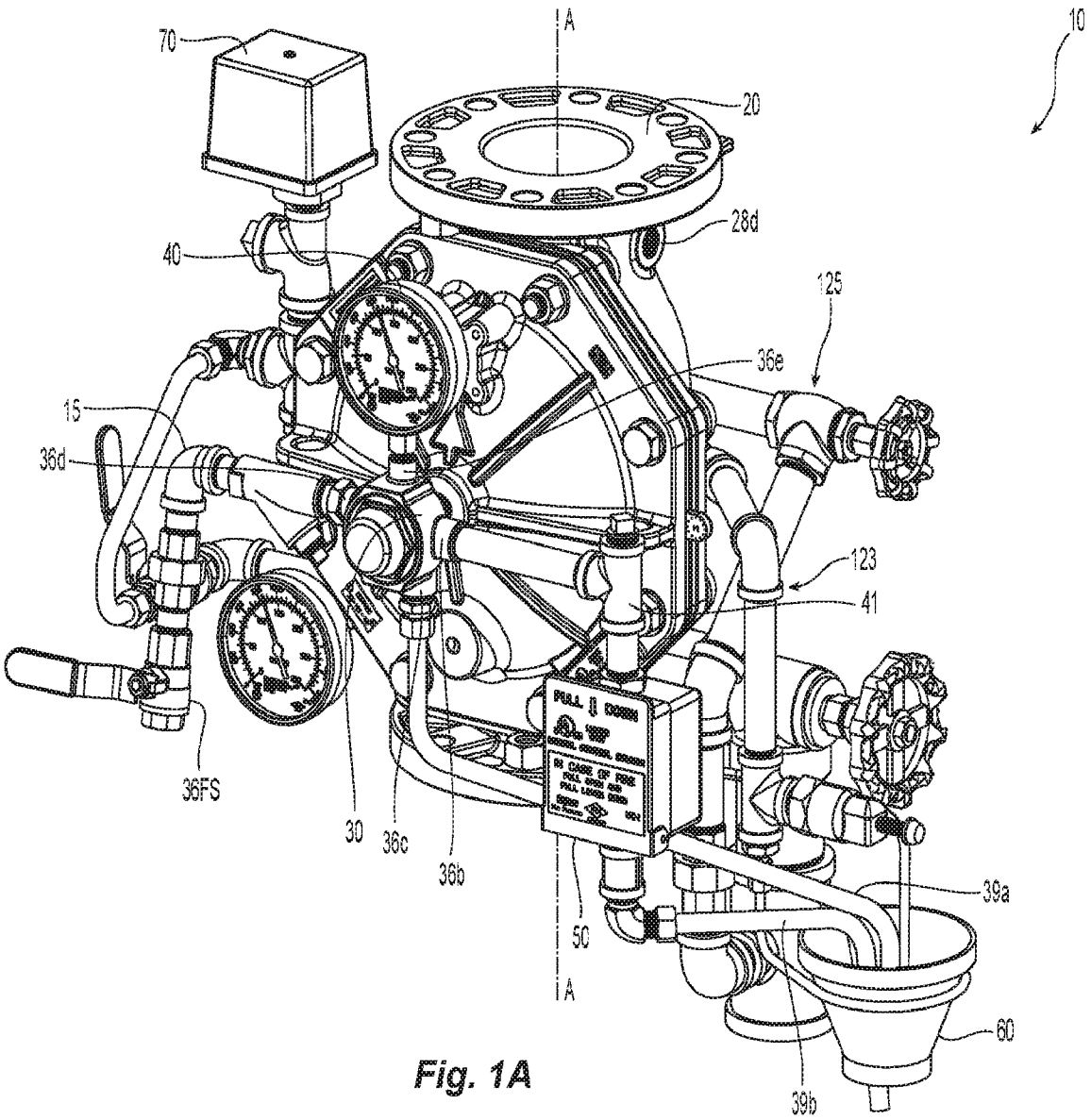
FIG. 1A is a front perspective view of a first preferred embodiment of a fluid control valve and valve actuator assembly.
Figure 1B:
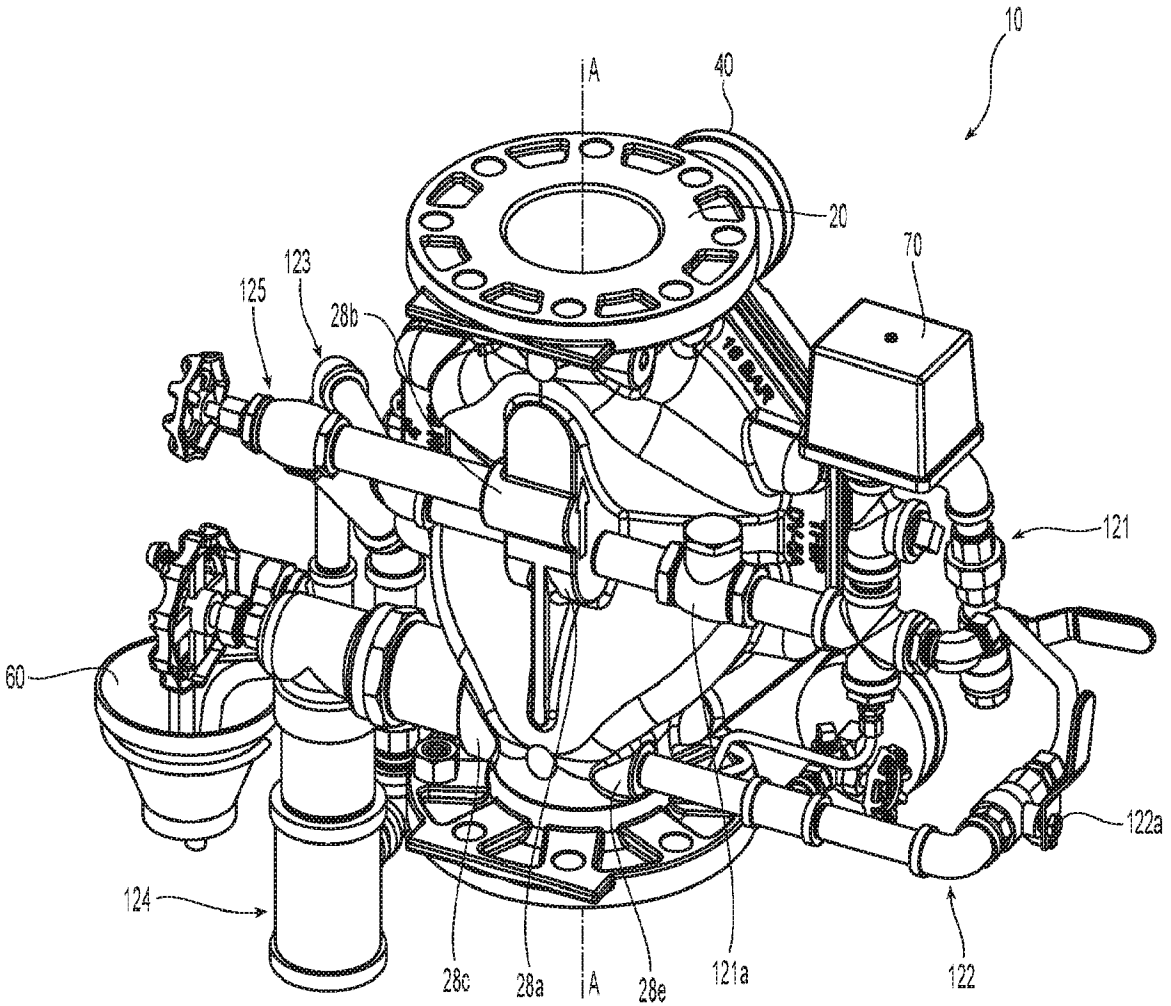
FIG. 1B is a rear perspective view of the fluid control valve and valve actuator assembly of FIG. 1A.
Figure 1C:
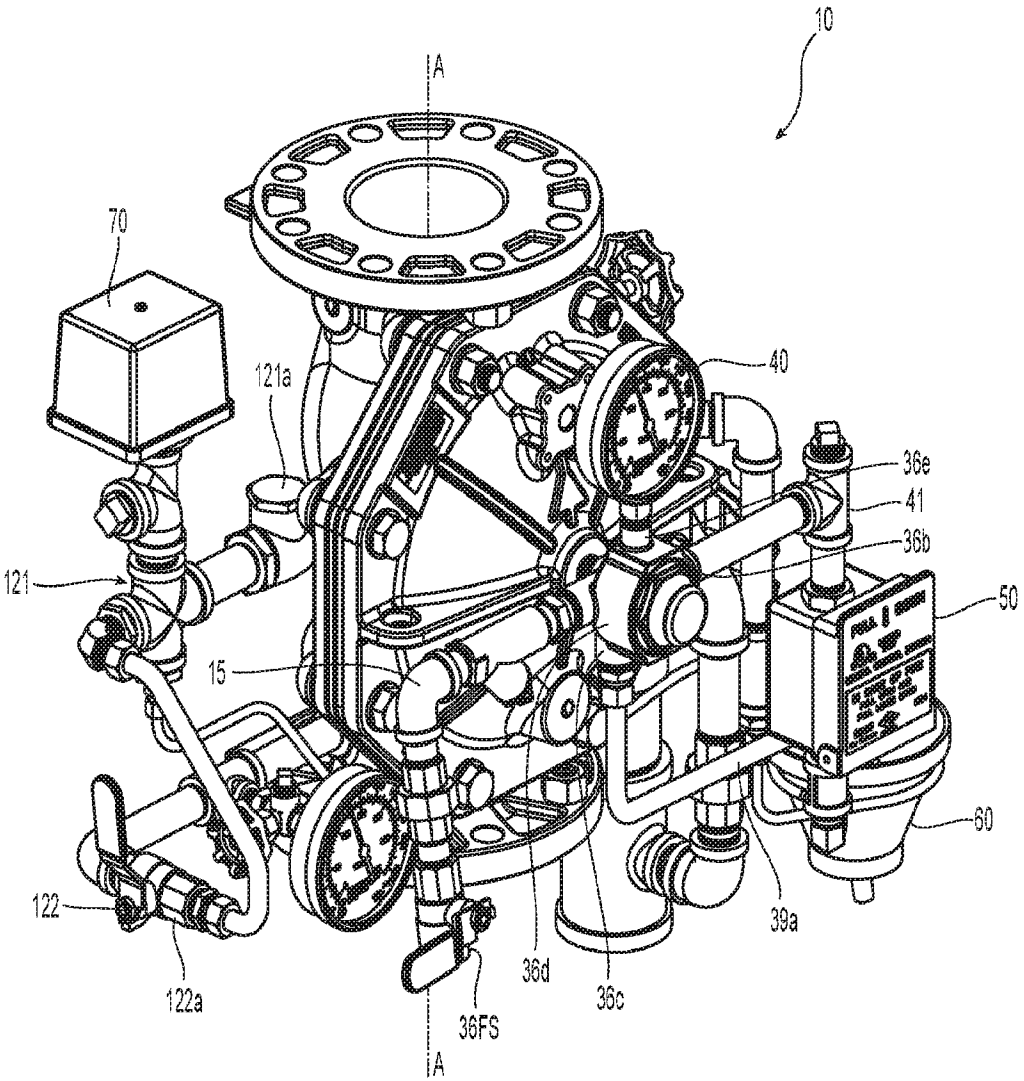
FIG. 1C is a side perspective view of the fluid control valve and valve actuator assembly of FIG. 1A.
Figure 4:
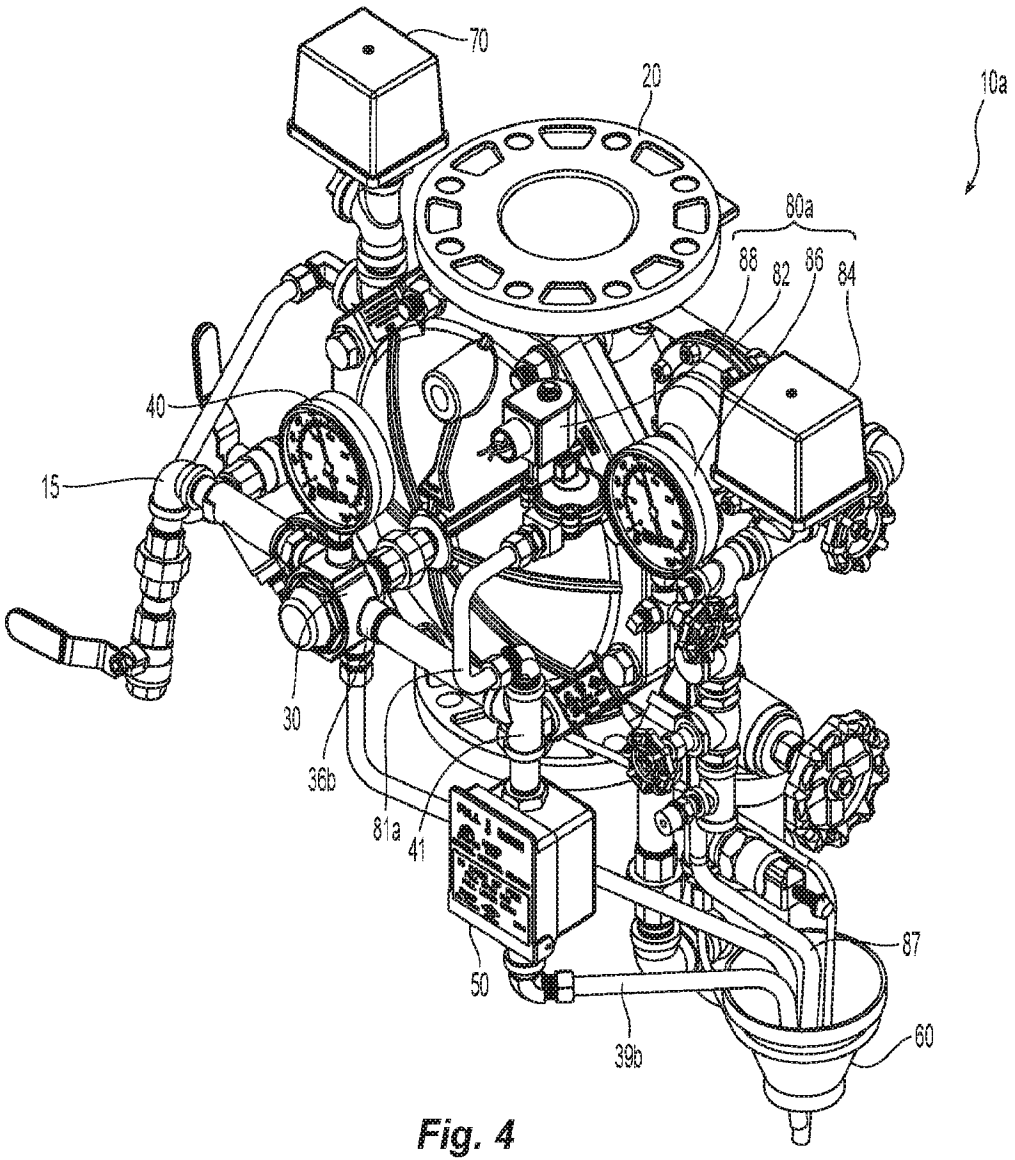
FIG. 4 is a perspective view of a preferred pneumatic and electric automatic control device module in the assembly of FIG. 1A.
Figure 5:
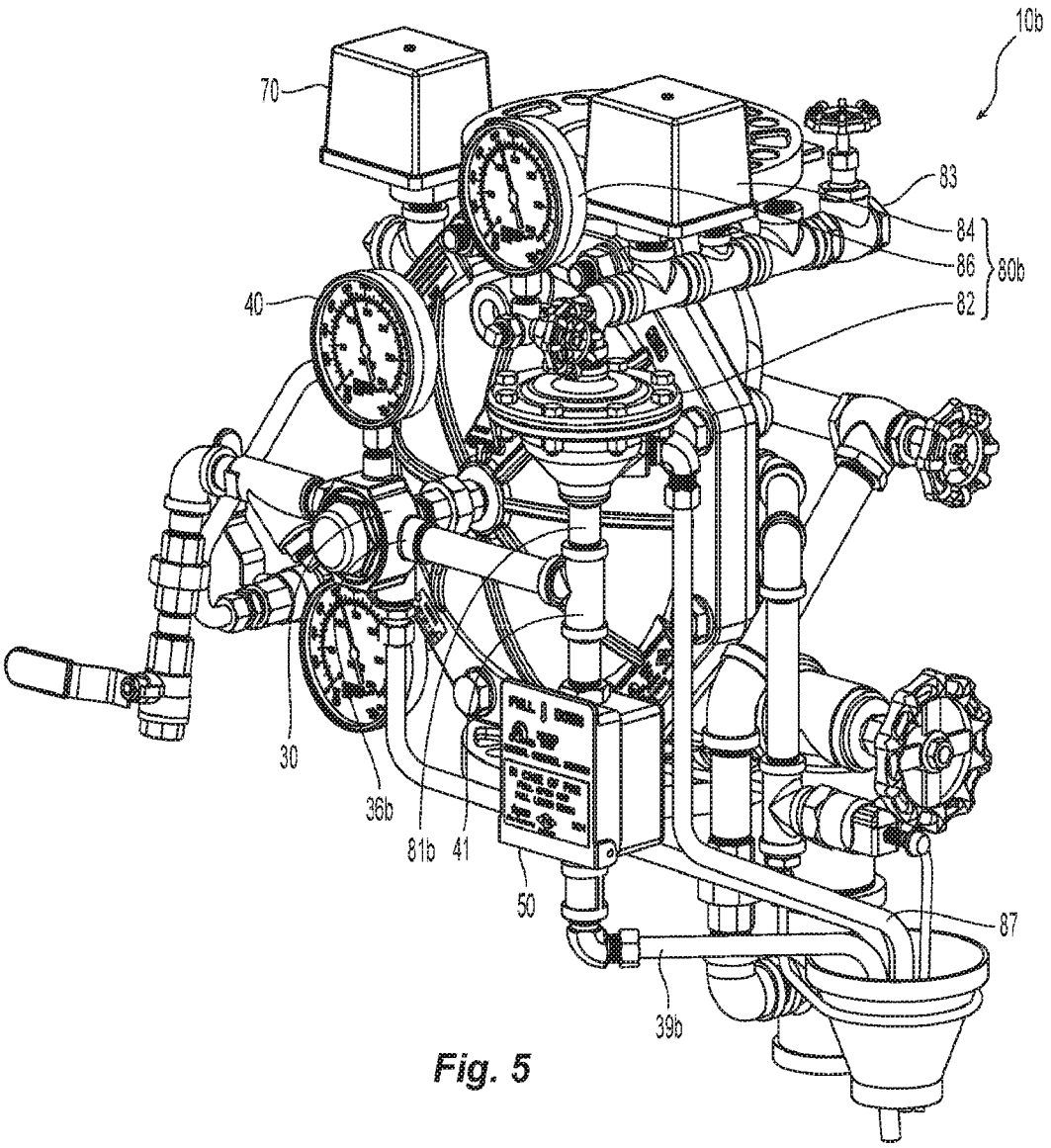
FIG. 5 is a perspective view of a preferred pneumatic automatic control device module in the assembly of FIG. 1A.
Figure 6:
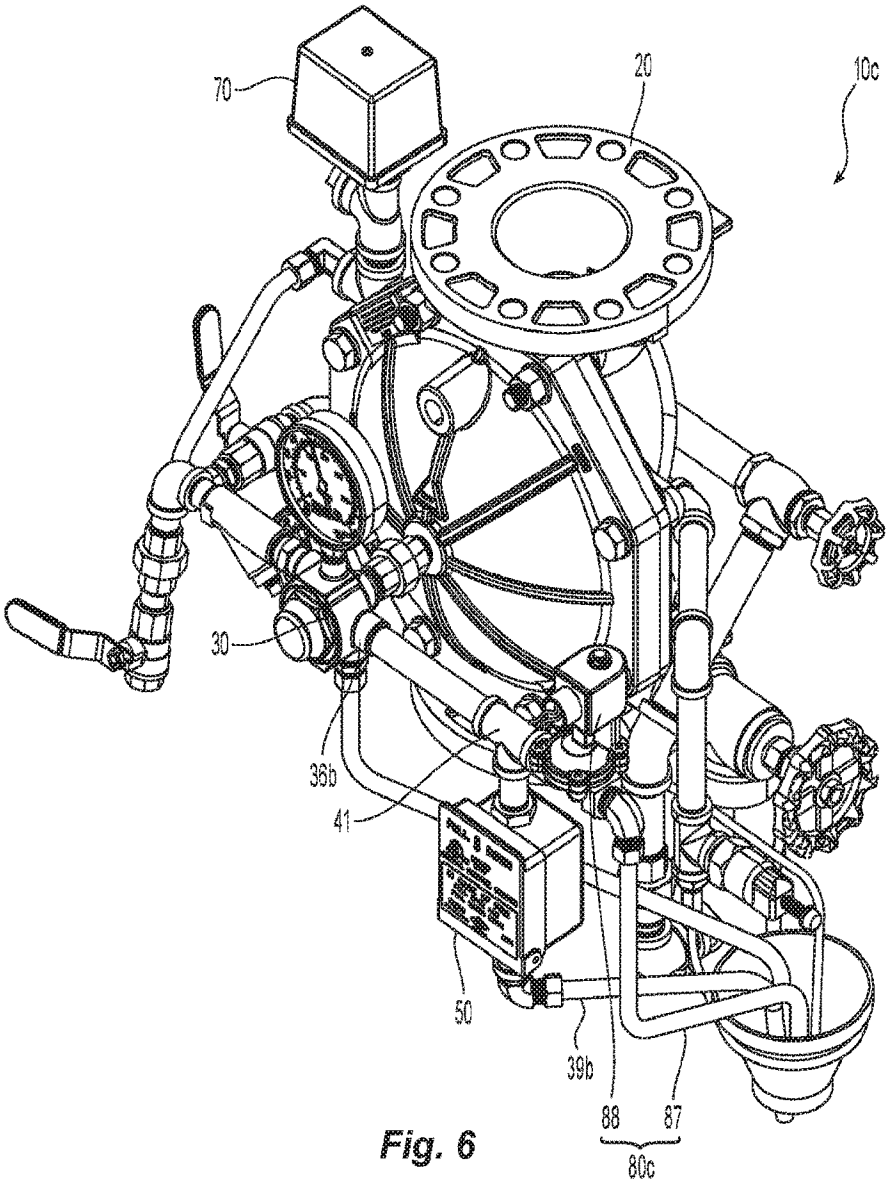
FIG. 6 is a perspective view of a preferred electric automatic control device module in the assembly of FIG. 1A.

Exemplary embodiments of the present invention are directed to systems and methods in which a fluid control valve is operated by a valve actuator utilizing a minimum number of ports to reliably actuate the fluid control valve. In addition, the port configuration of the preferred valve actuator and the internal assembly of the preferred valve actuator provide for a more compact configuration in terms of length and width than related art actuators. FIGS. 1A-1C show a preferred embodiment of an integrated base fluid control valve and valve actuator assembly 10 with a preferred fluid control valve 20 and a valve actuator 30 for preferably controlling the flow of liquid in a fire protection system. The valve actuator 30 preferably provides for manual setting or resetting of the control valve 20 to an unactuated ready state and for preferably tripping the control valve 20 automatically and/or manually to an actuated or operated state. Either one of or both of the preferred fluid control valve 20 and valve actuator 30 are preferably pressure operated. Accordingly, the base assembly 10 further preferably includes a pressurizing line 15, a pressure gauge 40, and manual release device 50 preferably coupled to the valve actuator 30. The preferred base assembly 10 further preferably includes a drip funnel or cup 60 for connecting fluid control components including the valve actuator 30 to a drain line. FIGS. 4, 5 and 6 are respective alternative embodiments of a preferred fluid control valve and valve actuator assembly 10*a*, 10*b*, 10*c* that includes the base fluid control valve and valve actuator assembly with a preferred respective automatic control device or module 80, which can be the respective control trim devices 80*a*, 80*b*, 80*c* coupled to the valve actuator 30 for automatic operation of the assembly 10*a*, 10*b*, 10*c*. More particularly shown in FIG. 4 is a preferred integrated fluid control valve and valve actuator assembly 10*a* with a preferably double interlock trim module 80*a*. Shown in FIG. 5 is a preferred integrated fluid control valve and valve actuator assembly 10*b* with a pneumatic trim control module 80*b*. Shown in FIG. 6 is a preferred integrated fluid control valve and valve actuator assembly 10*c* with an electric trim control module 80*c*.

Figure 2B:
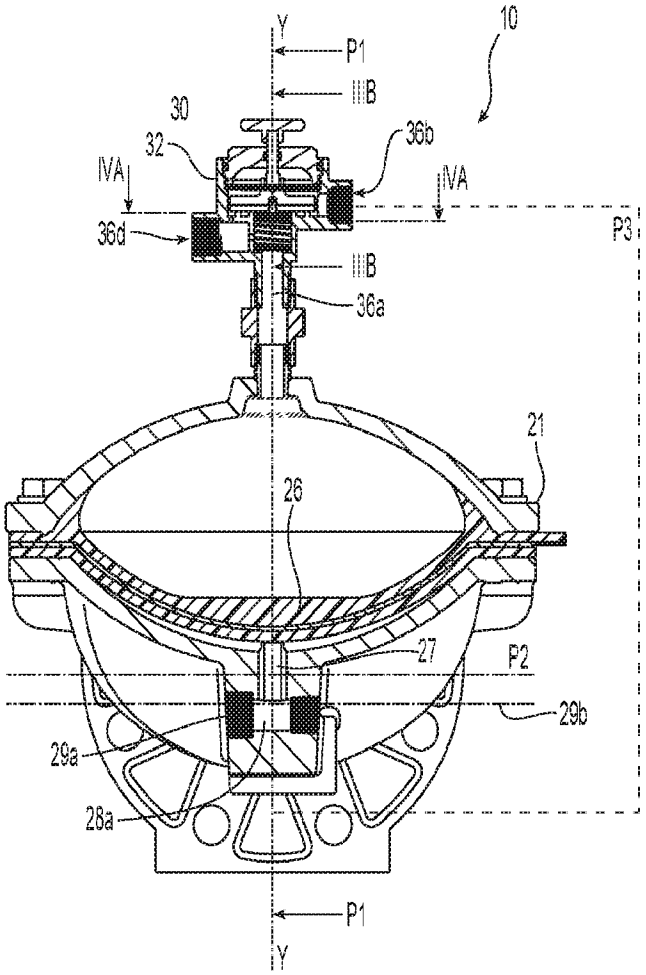
FIG. 2B is a cross-sectional view of the assembly of FIG. 2A along line IIB-IIB.
Figure 2A:
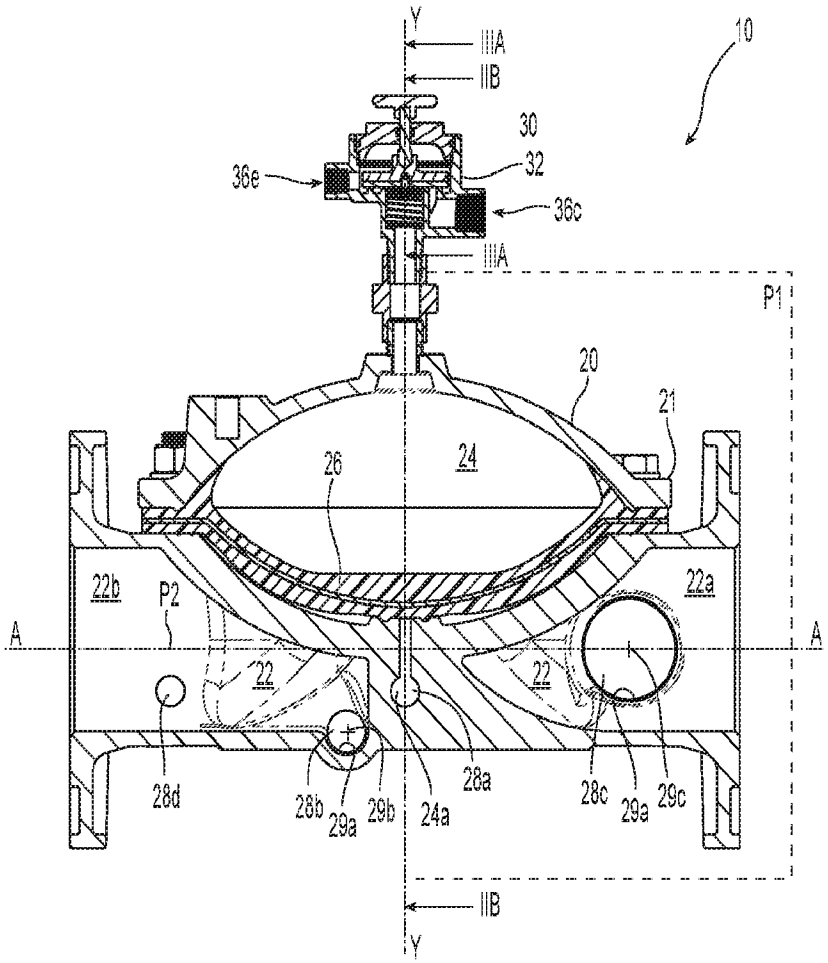
FIG. 2A is a cross-sectional view of a preferred fluid control valve and valve actuator used in the assembly of FIG. 1A.

Referring now to FIG. 2A-2B, show in cross-section is the integrated assembly 10 with a fluid control valve 20 for controlling the flow of liquid; and in particular, from a liquid supply piping system into a sprinkler piping system when transitioning the fire protection system from a stand-by state to an actuated state. Generally, a preferred fluid control valve 20 defines an internal fluid flow passageway or port 22 having an inlet 22*a* and an outlet 22*b*. The inlet and outlet 22*a*, 22*b* are preferably disposed along, spaced apart and centered along a longitudinal axis A-A and more preferably along longitudinal flow axis A-A. Moreover, each of the inlet and outlet 22*a*, 22*b* can include an appropriate connection for respectively coupling to a liquid supply pipe and sprinkler piping main or riser. Exemplary connections include flange ends as shown, but the control valve 20 can include alternative connections such as grooved end couplings. The internal flow port 22 is appropriately opened and closed for controlling the flow of liquid from the liquid supply piping system into the sprinkler piping system.

In a preferred embodiment of the base assembly 10, the fluid control valve 20 is a pressure operated valve 20 to open and close its internal port 22. More preferably, the fluid control valve 20 is a diaphragm pressure operated fluid control valve. In a preferred embodiment of the fluid control valve 20, the fluid control valve 20 includes a valve housing 21 that defines a valve chamber 24 housing an internally disposed valve diaphragm 26. The valve diaphragm preferably has a sealed position and an open position to control the flow of fluid through the internal port 22. The position of the valve diaphragm 26 is preferably controlled by fluid pressure acting on the internal diaphragm member 26. To prevent the flow of fluid through the control valve 20, the valve chamber 24 preferably holds a pressurized fluid to maintain the valve diaphragm 26 in the seated position. More specifically, when the valve chamber 24 is filled with fluid, the valve diaphragm 26 is sealed against an internal surface of the valve housing 21.

In one preferred aspect of the housing 21, the housing 21 defines a second central valve axis Y-Y that extends perpendicular to and preferably intersects the first flow axis A-A to define a first plane P1. The flow axis A-A further preferably defines a second plane P2 perpendicular to the first plane P1 with the flow axis A-A defining the intersection of the first and second planes P1, P2. For preferred embodiments the fluid control valve 20, components and features of the valve 20 and/or assembly 10 and its components are directed, located, disposed and/or oriented relative to the first and second planes P1, P2. For example, a preferred embodiment of the fluid control valve 20 and its housing 21 includes one or more ports 28*a*, 28*b*, 28*c*, 28*d* located medially between or relative to the inlet 22*a* and outlet 22*b* for fluid communication with preferably internal port 22. The medial ports 28 further preferably include a connection 29*a* defining a central axis 29*b*. In one preferred aspect, the preferred medial port 28 is disposed on one side of the second plane P2 with the central axis 29*b* extending parallel to the second plane P2 and perpendicular to the first plane P1. Moreover, in a preferred embodiment of the fluid control valve, the valve chamber is disposed to a first side of the second plane P2 opposite the medial port 28 disposed to the second side of the second plane P2.

For the embodiment of fluid control valve 20 shown in FIGS. 2A and 2B, the fluid control valve 20 preferably includes a first medially disposed port 28*a* which is preferably in fluid communication with a neutral chamber 27 that is in preferred fluid communication with the internal port 22 and the flow path of the valve 20. The first medial port 28*a* preferably places the neutral chamber 27 in fluid communication with the system alarm 70 (see, e.g., FIGS. 7A-7B) to detect and indicate flow through the valve 20. The system alarm 70 can include a fluid flow switch coupled to an alarm panel (not shown). The first medial port 28*a* and its preferred threaded connection 29*a* and central axis are shown preferably oriented and located such that the central axis of connection 29*a* of the neutral chamber port 28*a* extends parallel to the second plane P2 and perpendicular to the first plane P1. Alternatively, the connection 29*a* of the neutral chamber port 28*a* can be oriented and located such that its central axis is in alignment or parallel with the central axis Y-Y. Preferably disposed about the first medial port 28*a* and neutral chamber 27 are a first (or upper) and second (or lower) drain ports 28*b* and 28*c*. The upper and lower drain ports 28*b* and 28*c* facilitate the draining of the fire system piping after use so that the fire system can be set to the stand-by state. The upper and lower drain ports 28*b* and 28*c* are preferably oriented and located with their respective connections 29*b*, 29*c* parallel to the second plane P2 and perpendicular to the first plane P1 as shown. Accordingly, drain piping coupled to the drain ports 28*b*, 28*c* and control piping coupled to neutral chamber port 28*a* can be preferably oriented parallel to the second plane P2 and perpendicular to the first plane P1. Thus, exemplary embodiments of the control valve 20 can be mounted in close proximity to a wall.

The preferred orientations of the medial ports and connections 28, 29 can present the preferred fluid control valve 20 and assembly 10 with a compact profile for mounting and installation. More specifically, the preferred orientation of the medial ports and connections 28, 29 can preferably orient and locate associated alarm system and drain piping to one side of and parallel to the second plane P2. For the preferred valve and actuator assemblies 10 described herein, this permits the drain and alarm piping to be mounted close and parallel to walls or other environmental structures, as compared to configurations where the medial ports and connections 28, 29 are parallel to pane the first plane P1. With the valve actuator 30 and its associated components preferably disposed on the opposite side of the second plane P2 from the alarm and drain piping, the installation renders the valve actuator 30 and its associated components accessible to a user or operator for set up or maintenance. Moreover, the preferred embodiment disclosed herein utilizing the control valve 20 configuration allows for orientation of the system alarm 70 and its respective components at a minimal distance located from the longitudinal axis A-A of the control valve 20. The preferred distance from the longitudinal axis of the valve A-A to the center line of the system alarm 70 is preferably less than five inches.

Figure 3A:
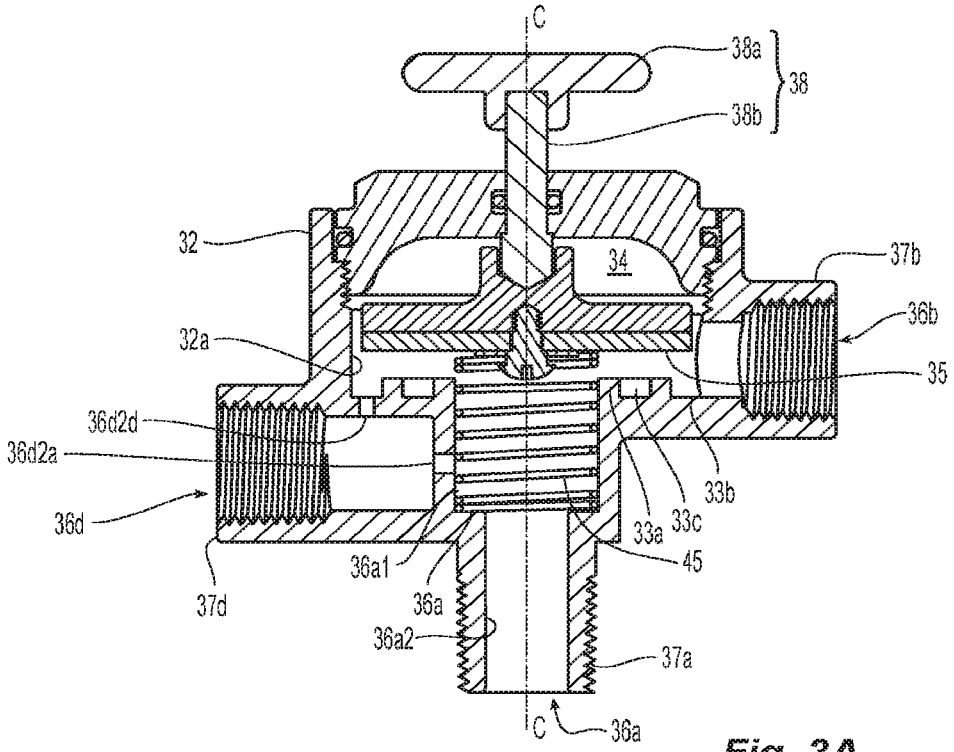
FIG. 3A is another cross-sectional view of the preferred valve actuator along line IIIA-IIIA in FIG. 2A with the valve actuator in the open (actuated) position.
Figure 3B:
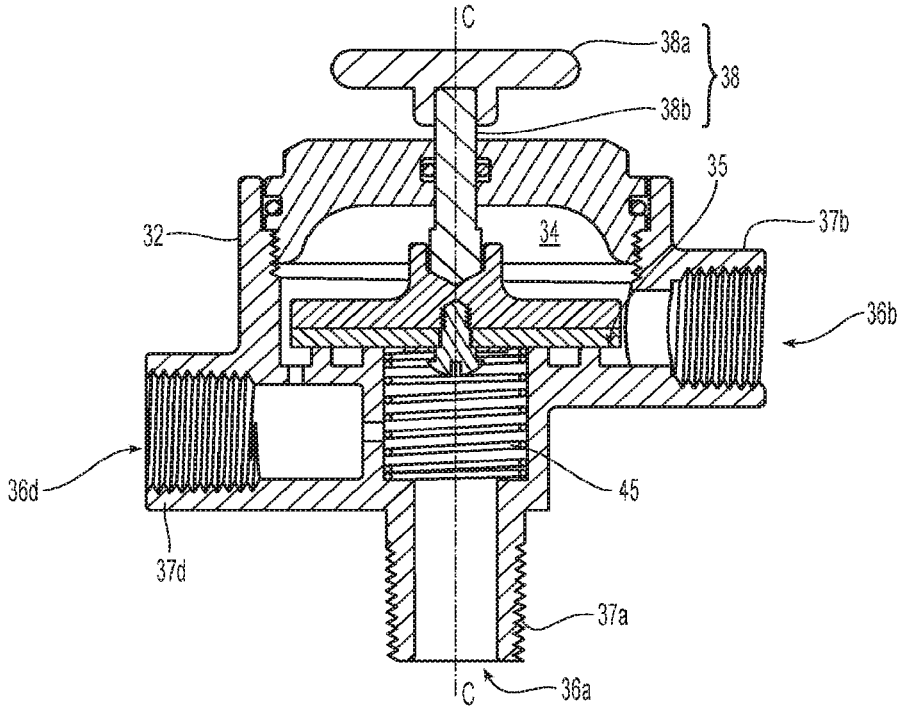
FIG. 3B is another cross-sectional view of the preferred valve actuator along line IIIA-IIIA in FIG. 2A with the valve actuator in the closed (reset) position.
Figure 3C:
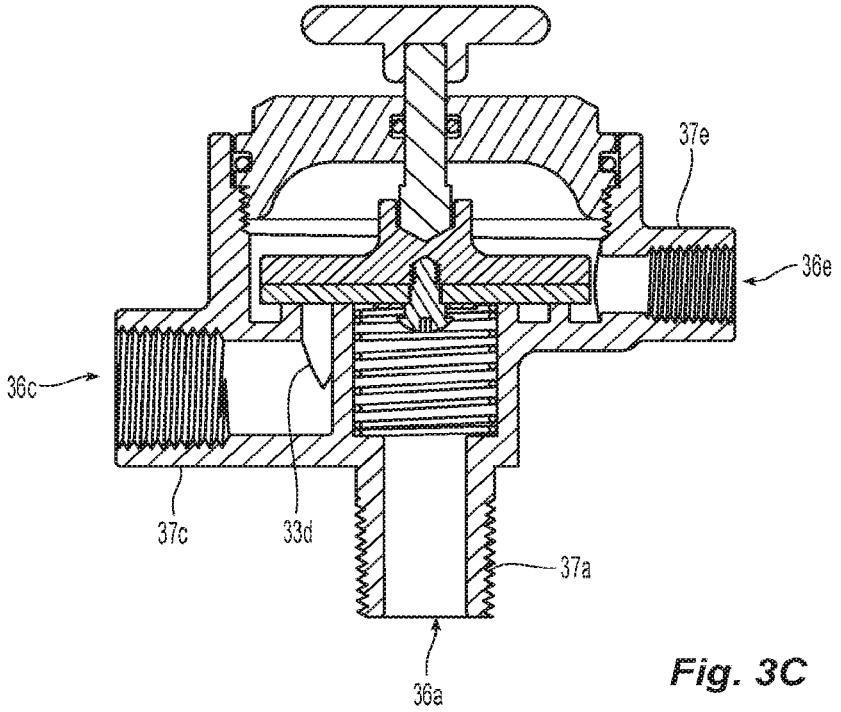
FIG. 3C is another cross-sectional view of the preferred valve actuator along line IIIB-IIIB in FIG. 2A.
Figure 3D:
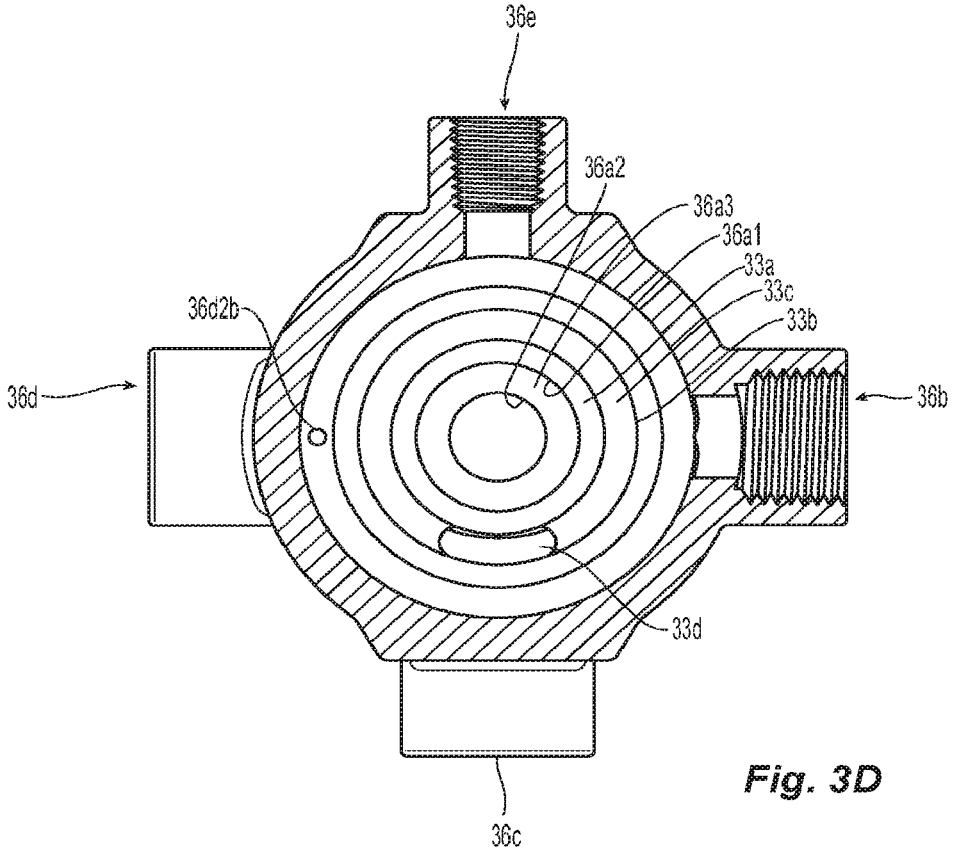
FIG. 3D is another cross-sectional view of the preferred valve actuator along line IVA-IVA in FIG. 2A.

The preferred embodiments of the integrated assembly 10 provide a valve actuator 30 proximate to, preferably coupled to, and even more preferably secured, to the valve housing 21 of the fluid control valve 20, for example, as seen in FIGS. 2A and 2B. Moreover the actuator 30 is preferably coupled to the preferred fluid control valve 20 so as to be disposed to a side of the second plane P2 opposite, for example, an alarm port 28*a* or neutral chamber 27. As shown in FIGS. 3A and 3B, the actuator 30 has a housing 32 that includes an interior surface 32*a* defining an internal chamber 34 that controls the volume of pressurized fluid within the valve chamber 24 of the control valve 20 (see FIG. 2A) and the pressure acting on the preferred valve diaphragm 26 to control the flow of liquid through the control valve 20. Generally, the preferred valve actuator 30 includes a group of ports 36*a-e* (see FIGS. 3A-3C) including at least one port that places the internal chamber 34 of the actuator 30 in fluid communication with the valve chamber 24 and including one or more ports 36*a-e* in fluid communication with the internal chamber 34 and valve chamber 24 to increase or decrease the fluid pressure within the valve chamber 24 acting on the preferred diaphragm member 26 to close or open the internal fluid port 22 of the fluid control valve 20.

In a preferred embodiment of the valve actuator 30, the actuator housing 32 preferably includes or defines five ports 36*a*, 36*b*, 36*c*, 36*d*, 36*e* in communication with the internal chamber 34. However, a preferred embodiment can include only four ports 36*a*, 36*b*, 36*c*, 36*d*. In addition, each of the ports preferably includes a respective connection 37*a*, 37*b*, 37*c*, 37*d*, 37*e* for coupling to the respective port and placing the internal chamber 34 in fluid communication with another area, region, chamber, or ports of the actuator or assembly 10. The connection can be embodied as threaded connection, a fitted connection, quick-connection, or any other mechanical connection for coupling the port. In one preferred aspect, the first preferred connection 37*a* allows port 36*a* to provides fluid communication between the valve chamber 24 of the fluid control valve 20 and the internal chamber 34 of the valve actuator 30. In another preferred aspect, the second connection 37*b* provides fluid communication through port 36*b* between the internal chamber 24 and the automatic control device or module 80, e.g. a device that preferably detects and/or indicates that a fire protection sprinkler system coupled to the assembly 10 has transitioned from a stand-by state to an actuated state and/or a manual release device 50, which is further preferably connected to a drain or port 39*b*, as seen for example in FIG. 1A. In a preferred embodiment both the automatic control device or module 80 and the manual release device 50 are connected to port 36*b* using a common connection, e.g., a T-connection 41 (see FIGS. 4-6), which allows for the elimination of a port when compared to related art valve actuators. A third connection 37*c* provides fluid communication via third port 36*c* between the internal chamber 24 and a drain or port via, e.g., a drain line 39*a*, as seen for example in FIG. 1A. The fourth port 36*d* and its connection 37*d* preferably provides fluid communication to the internal chamber 34 from a fluid supply via fluid supply connection 36*fs*. A preferred fifth connection 37*e* provides fluid communication between the internal chamber 24 and the pressure gauge 40, seen for example in FIG. 1A. As shown herein, the end of the drain line 39*a* from the third connection 37*c*, the end of the drain line 87 from the automatic control device or module 80 and the end of the drain line 39*b* (see FIGS. 4-6) from the manual release device 50 are preferably disposed in the drip funnel 60. In the preferred embodiments, the control valve 20 via valve housing 21 supports a drip funnel 60. Moreover, the drip funnel 60 can be supported relative to one or more reference planes or axes, such as for example, the drip funnel 60 can be supported to one side of the second plane P2 opposite the valve actuator 30 or alternatively be supported on the same side of the second plane P2 as the valve actuator 30.

FIG. 3A-3D are various cross-sectional views of the preferred valve actuator. FIG. 3A shows the valve actuator 30 the open (actuated) position and FIG. 3B shows the valve actuator 30 in the closed (reset) position. Referring to FIGS. 3A-3D, the preferred valve actuator housing 32 and internal chamber 34 preferably define a central axis C-C. A first actuator seat 33*a* is disposed along the interior surface 32*a* of the housing 32, preferably, circumscribed about the central axis C-C, and a second actuator seat 33*b* is disposed along the interior surface 32*a*, preferably, circumscribed about the first actuator seat 33*a*. A seal or sealing member 35 disposed within the internal chamber 34 defines a preferred sealed position, in which the seal or sealing member 35 is engaged with the first actuator seat 33*a* and the second actuator seat 33*b*. The seal member 35 further defines an open position, in which the seal or sealing member 35 is axially spaced from the first and second actuator seats 33*a*, 33*b*. In the preferred valve actuator 30, the first port 36*a* is preferably located proximate the first actuator seat 33*a* in communication with the internal chamber 34. For the preferred actuator, the third port 36*c* is isolated from the first and second ports 36*a*, 36*b* when the sealing member 35 is in the sealed position. When the sealing member 35 is in the open position, the third port 36*c* is in fluid communication with the first port 36*a* and the second port 36*b*. The fourth port 36*d* is isolated from the third port 36*c* when the sealing member 35 is in the sealed position; and when the sealing member 35 is in the open position, the fourth port 36*d* is in fluid communication with the third port 36*c*. In the preferred embodiment, the fourth port 36*d* defines a first bore 36*d*2*a* that is in fluid communication with the first port 36*a*, and a second bore 36*d*2*b* that is in fluid communication with the internal chamber 34. The configuration of the first bore 36*d*2*a* and second bore 36*d*2*b* ensures that, when the sealing member 35 is in the open position, fluid pressure will not build up in the internal chamber 34. That is, fluid in the internal chamber 34 can flow out of the third port 36*c* and to the drain line 39*a* at a rate greater than that of fluid flow into internal chamber 34 from port 36*d*, which is connected to the system fluid supply. In a preferred embodiment, the first bore diameter is larger than the second bore diameter. Preferably, the first bore 36*d*2*a* is ⅛ inch in diameter and the second bore 36*d*2*b* is 3/32 inch in diameter, and the third port 36*c* and fourth port 36*d* are ½ inch in diameter. Of course, these dimensions are not limiting and other dimensions can be used depending on the desired performance of the system.

Figure 3E:
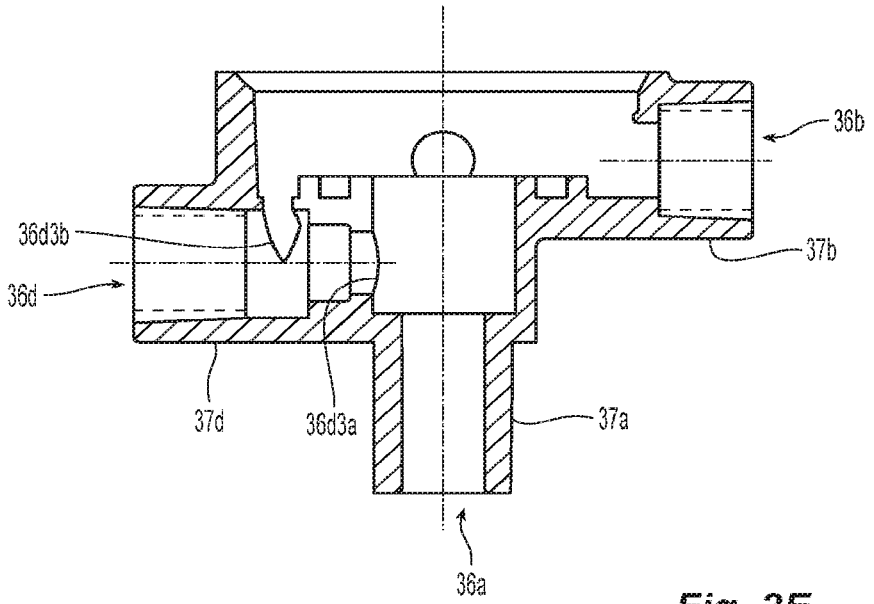
FIG. 3E is a cross-sectional view of a port body of a preferred valve actuator along line IIIB-IIIB in FIG. 2A.
Figure 3F:
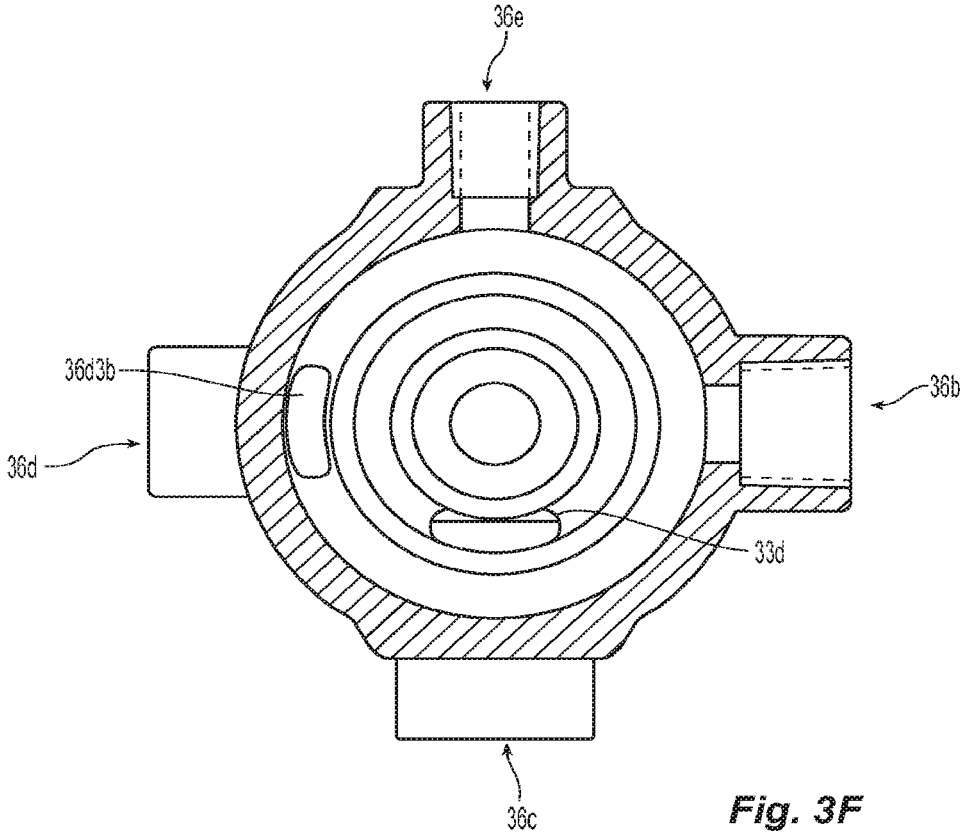
FIG. 3F is a cross-sectional view of a preferred valve actuator along line IVA-IVA in FIG. 2A.

FIGS. 3E and 3F disclose a preferred embodiment of a valve actuator 30 that can be used with control valves that connect to piping ranging from 1.5 inches to 12 inches without having to reconfigure the internal bore configuration of the valve actuator. For clarity, only a cross-section of the port body section is shown in FIG. 3E. In the preferred embodiment, the fourth port 36*d* defining a first opening 36*d*3*a*, e.g., a circular opening, at an end of the fourth port 36*d* that opens into the first port 36*a* to provide fluid communication with the first port 36*a*. Preferably, the fourth port 36*d* has a reduction in the port diameter along its length. In some embodiments the reduction can be a stepwise reduction in the diameter, as shown in FIG. 3E. In some embodiments, the reduction in diameter can be a smooth taper. The fourth port 36*d* also includes a second opening 36*d*3*b*, e.g., an oblong opening, that opens into the internal chamber 34 to provide fluid communication with the internal chamber 34. The first opening 36*d*3*a* and the second opening 36*d*3*b* can be any shape such as, e.g., oblong, circular, square, elliptical or any other desired shape. In addition, the configuration of each of the first opening 36*d*3*a* and the second opening 36*d*3*b* is not limited to single opening and can include more than one opening. Preferably, the first and second openings 36*d*3*a* and 36*d*3*b* are configured such that they can accommodate a variety of control valve sizes that connect to piping ranging from 1.5 inches to 12 inches. Preferably, the configuration of the first opening 36*d*3*a* and second opening 36*d*3*b* ensures that, when the sealing member 35 is in the open position, fluid pressure will not build up in the internal chamber 34. That is, fluid in the internal chamber 34 can flow out of the third port 36*c* and to the drain line 39*a* at a rate greater than that of fluid flow into internal chamber 34 from port 36*d*, which is connected to the system fluid supply. In a preferred embodiment, the cross-sectional area of the first opening 36*d*3*a* is larger than the cross-sectional area of the second opening 36*d*3*b*. Preferably, the size of the first opening 36*d*3*a* is approximately 0.40 inch in diameter. Preferably, the length of the second opening 36*d*3*b* is in a range of approximately 0.540 inch to 0.900 inch and the width is in a range of approximately 0.141 inch to 0.235 inch. Preferably, the length of the second opening 36*d*3*b* is approximately 0.720 inch and the width of the second opening 36*d*3*b* is approximately 0.188 inch. Of course, these dimensions are not limiting and other dimensions can be used depending on the desired performance of the system. In operation, an appropriately sized flow restriction device can be used, if need, based on the application, to accommodate the control valve size and/or to appropriately adjust the trip and reset timings on the valve actuator 30. For example, the fourth port 36*d* can be configured to accept, e.g., via a threaded connection, a flow reducing device such as, e.g., an in-line plug-type fitting with a channel extending through the fitting. The diameter of the channel is appropriately sized for the desired trip and reset times for the valve actuator 30, the control valve size (i.e., inlet and outlet connection size) and/or the application. For example, the diameter of the channel in the flow restriction device can be in a range from ⅛ inch to ⅜ inch depending on the control valve size, with the smaller control valves typically requiring a smaller diameter for the channel and the larger control valves typically requiring a larger diameter for the channel By using a separate flow restriction device in conjunction with appropriately sized openings 36*d*3*a* and 36*d*3*b*, the same valve actuator 30 can be used on a wide range of control valve sizes and/or applications. For example, if the control valve is changed to a different size, the trip and reset timings on the valve actuator 30 with openings 36*d*3*a* and 36*d*3*b* can be reconfigured for the new valve by simply changing to a different flow restriction device rather than having to replace the actuator or reconfigure the bore or opening sizes in the actuator.

The preferred valve actuator 30 includes at least one biasing member 45 to bias the sealing member 35 in the open position. The biasing member 45 is configured such that, when the sealing member 35 is in the closed or sealed position, the fluid pressure in the internal chamber 34 overcomes the bias force of the at least one biasing member 45 and the sealing member 35 is pressed against first and second actuator seats 33*a*, 33*b*. When there is no or little fluid pressure in the internal chamber 34, e.g., due to fluid in the internal chamber 34 flowing out of the second port 36*b*, the bias force of the at least one biasing member 45 forces the sealing member 35 to the open position. Preferably, the at least one biasing member 45 is disposed such that it is within a sealing boundary formed between the first actuator seat 33*a* and the seal member 35 when the seal member 35 is in the sealed position. That is, the at least one biasing member 45 is disposed such that a radial distance from the central axis C-C to an outermost portion of the at least one biasing member 45 is less than or equal to a radial distance from the central axis C-C to an inner portion of the seal boundary. By disposing the at least one biasing member 45 within the sealing boundary, the width of the preferred valve actuator 30 can be reduced when compared to the width of related art actuators in which the biasing member circumscribes the actuator seat assembly. Thus, exemplary embodiments of the preferred valve actuator 30 provide for a more compact configuration. In the preferred valve actuator 30, the first port 36*a* includes a first portion 36*a*1 and a second portion 36*a*2. The first portion 36*a*1 has a larger diameter than the second portion 36*a*2 of the first port 36*a*. Preferably, the transition from the first portion 36*a*1 to the second portion 36*a*2 is a step change that forms land portion 36*a*3. Preferably, the at least one biasing member 45 is disposed between the interior surface of the first port 36*a* and the sealing member 35 to bias the sealing member 35 toward the open position. Preferably, one end of the at least one biasing member 45 is engaged with an interior surface of the first port 36*a* and preferably disposed on the land portion 36*a*3 and the other end of the at least one biasing member 45 is disposed on the sealing member 35. The at least one biasing member 45 is, preferably, at least one spring member. The at least one spring member 45 is, preferably, at least one coil spring having a first end engaged with the land portion 36*a*3 of the first port 36*a* of the actuator 30. The second end of the coil spring is preferably engaged with a portion of the sealing member 35 that faces the first actuator seat 33*a*. In a preferred embodiment, each of the first and second actuator seats 33*a*, 33*b* are preferably substantially circular, the first actuator seat 33*a* having a first diameter and a second actuator seat 33*b* having a second diameter, the second diameter being greater than the first diameter.

Preferably, the sealing member 35 is centered about the central axis C-C in the open position and in the closed position. Moreover, in some embodiments, the sealing member 35 is preferably supported in the open position within the housing exclusively by a frictional engagement with the at least one biasing member 45 such that sealing member 35 is not supported by any other valve structure. That is, the bias force of the at least one biasing member 45 presses the sealing member 35 against the housing 32 and the frictional force between the at least one spring member 45 and the sealing member 35 keeps the sealing member 35 in place. The sealing member 35, when in a sealed position with the first and second actuator seats 33*a*, 33*b*, preferably defines an annular channel 33*c*. Preferably, the channel 33*c* includes an opening 33*d* in a surface of the channel 33*c* that is opposite the sealing member 35. The opening 33*d* is preferably in communication with the third port 36*c* of the preferred actuator 30, which is preferably connected to drain line 39*a*. The shape of the opening is preferably oblong. However, the opening can include other shapes such as circular, square, elliptical or any other desired shape. In addition, the configuration is not limited to one opening and the channel 33*c* can include more than one opening 33*d* in communication with port 36*c*. Preferably, the opening 33*d* is ⅝ inch in length, however, other lengths can be used depending on factors such as the diameter of port 36*c*. The sealing member 35 preferably comprises a cylindrical member or assembly, having a first distal side opposed to the first and second actuator seats 33*a*, 33*b* and a second proximal side opposite the distal side. The distal side of the seal member 35 preferably includes a seal that engages the first actuator seat and the second actuator seat in the sealed position.

As seen in FIGS. 3A and 3B, preferred embodiments of the control valve and valve actuator assembly 10 further include the manual reset actuator 38 to preferably reset the assembly 10 to its ready-state. The manual reset actuator 38 has a button 38*a* for operation by a user. The button 38*a* is operatively connected to the sealing member 35 by a locating structure or shaft 38*b*. The preferred orientation of the manual reset actuator 38 with respect to the valve housing 21 of the fluid control valve 20 allows for the integrated assembly 10 to be a compact configuration and orientation of the components associated with each of the connections 37*a-e*. The manual reset actuator 38 is operated by displacing the button 38*a* toward the fluid control valve 20 so as to preferably locate the seal member 35 in or toward its sealed position. In particular, the manual reset actuator 38 is actuated toward the longitudinal axis A-A of the fluid control valve 20.

The ports 36*a-e* and/or their respective connections 37*a-e* are preferably oriented, directed and/or located in a preferred configuration relative to one or more reference axes, planes, surfaces and/or components of the assembly 10 to provide the arrangement of the integrated assembly. For example, referring to FIGS. 2A, 2B and 3A, the first connection 37*a* and preferably its axial center is preferably disposed in a first direction coaxially to the preferred valve axis Y-Y toward the longitudinal axis A-A of the fluid control valve 20 and more preferably perpendicular to the second plane P2. Of course, the first connection 37*a* can be disposed on the fluid control valve 20 at another location that provides fluid communication with the valve chamber 24. The second connection 37*b* and the fourth connection 37*d* and their axial centers are preferably located in a second direction transverse to the first connection 37*a* and more particularly in a direction transverse to the longitudinal axis A-A and parallel to second plane P2. The third connection 37*c* and its axial center is preferably located in a third direction transverse to the first connection 37*a* and the second and fourth connections 37*b*, 37*d* and more particularly in a direction parallel to the longitudinal axis A-A and parallel to second plane P2. Alternatively, the second connection 37*b* and/or the fourth connection 37*d* can be disposed in a direction of the longitudinal axis A-A of the control valve 20, and/or the third connection 37*c* can be disposed transverse to the longitudinal axis A-A of the control valve 20. The second connection 37*b* is preferably located at an opposed location on the actuator housing 32 from the fourth connection 37*d*. With this orientation of the first, second, third and fourth connections 37*a*, 37*b*, 37*c*, 37*d*, the manual reset actuator 38 is preferably axially aligned with the first connection 37*a*. Preferably, the fifth connection 37*e* is preferably at an opposed location on the actuator housing 32 from the third connection 37*c* and in a direction preferably parallel to longitudinal axis A-A of the control valve 20. Preferably, the axis of the third connection 37*c* is offset in a radial direction from the axis of the second connection 37*b*. Preferably, the second connection 37*b* is offset by approximately 90 degrees radially from the third connection 37*c* and the third connection 37*c* is offset by approximately 90 degrees radially from the fourth connection 37*d*. The fifth connection 37*e* and preferably its axial center is located in the third direction. Accordingly, the orientation of the center line of the first connection 37*a* is preferably at a right angle with the center line of each of the second to fifth connections 37*b*-37*e*, and the center line of the second connection 37*b* is at a right angle with the center lines of the third and fifth connections 37*c*, 37*e*, and the center lines of the second and fourth connections 37*b* and 37*d* are substantially parallel and the center lines of the third and fifth connections 37*c* and 37*e* are substantially parallel. In a preferred embodiment, the center lines of the second and fourth connections 37*h* and 37*d* are disposed in a common plane preferably perpendicular to the first and second planes P1, P2 and parallel to a third plane P3, and the center lines of the third and fifth connections 37*c* and 37*e* are disposed in another common plane parallel to first plane P1 and preferably perpendicular to second and third planes P2, P3. It should be understood that, although in the preferred embodiments, the orientation of the connections 37*a-e* are configured such that their respective centerlines are at right angles, the central lines can be skewed as long as the respective connections are transverse with each other in a manner as described.

In the preferred embodiments, the fourth connection 37*d* and the third connection 37*c* are disposed transverse to each other on the actuator housing 32 and are located parallel to the second plane P2 and preferably perpendicular to the first plane P1, and the third connection 37*c* is disposed between the second connection 37*b* and the fourth connection 37*d*. The second and fourth connections 37*b* and 37*d* are preferably disposed opposite each other on the actuator housing 32 so that they are disposed alternating on the actuator housing 32 with the third and fifth connections 37*c*, 37*e*, which are disposed opposite each other on the actuator housing 32.

The operation of the valve actuator 30 provides a stand-by state defined by the sealing member 35 engaged with first actuator seat 33*a* and the second actuator seat 33*b* and an actuated (or tripped) state defined by the sealing member 35 spaced from the first actuator seat 33*a* and the second actuator seat 33*b*. The method preferably includes establishing the stand-by state, which more particularly includes locating the sealing member 35 against the actuator seats 33*a*, 33*b*. The preferred method further includes providing fluid pressure from a common supply port, preferably the fourth port 36*d*, to a chamber, preferably the internal chamber 34, on a first side of the sealing member 35 and a port, preferably the first port 36*a*, on the second side of the sealing member. The preferred method further, preferably, includes establishing a trip state of the valve actuator 30, which particularly includes exposing the internal chamber 34 to an actuated automatic control device 80 and/or an actuated manual control device 50 via a common discharge port attached to the automatic control device 80 and the manual release device 50, preferably, via second port 36*b*. The method preferably further includes placing the first port 36*a* in fluid communication with the chamber 34, placing the internal chamber 34 in fluid communication with a drain via the third port 36*c* and releasing the sealing member 35 from the sealed position. In one preferred aspect of operating the valve actuator 30, pressurized fluid is provided from the internal chamber 34 to a drain line 39*a* at a rate greater than the rate of pressurized fluid provided to the internal chamber from the common supply port 36*d*. That is, the port 36*c* can drain pressurized fluid from chamber 34 faster than port 36*d* can supply the pressurized fluid.

In FIGS. 1A-1C, the first embodiment of a preferred integrated fluid control valve and valve actuator assembly 10 is shown. The embodiment is directed to an assembly 10 that includes a manual release device 50 connected to valve actuator 30 for manually actuating the fire system. Preferably, the valve actuator 30 is mounted directly on control valve 20 by connecting the first port 36*a* to the housing 21 of control valve 20 such that the first port 36*a* is in fluid communication with the valve chamber 24. The second port 36*b* is shown connected to a first port of a T-connection 41. The second port of the T-connection 41 is shown connected to a manual release device 50. A plug is disposed in the third port of the T-connection 41. The plug can be removed for connection to the piping of a control device, such as an automatic control device, e.g., a wet pilot control arrangement or an embodiment of an automatic control device or module 80, as discussed further below. As shown in FIG. 1A, the orientation of the T-connection 41 is disposed longitudinally and parallel with Axis A-A. However, the orientation of the T-connection 41 can be transverse to axis A-A, depending on, e.g., desired flow characteristics and available space. The manual release device 50 is preferably connected to a drain or port 39*b*, which is piped to drip funnel 60. The third port 36*c* of the valve actuator 30 is preferably connected to drain line 39*a*, which is also preferably piped to drip funnel 60. The fourth port 36*d* of valve actuator 30 is connected to the fluid supply via the common supply connection 36FS and associated piping. In the embodiment of FIGS. 1A-1C, the valve actuator 30 includes a port 36*e* that is connected to a pressure gauge.

As shown in FIGS. 1A-1C, alarm subassembly 121, which includes system alarm 70, check valve 121*a* and associate piping, is connected to one side of first medial port 28*a* of the control valve 20. Alarm test subassembly 122 is connected to the inlet port 22*a* via port 28*e*. The alarm test assembly 122 is connected to alarm subassembly via piping and valve 122*a* in order to periodically test the system alarm 70 without actuating the control valve 20. The check valve 121*a* prevents water from entering the first medial port 28*a* during the testing. During operation, if the system is triggered and the control valve 20 opens, pressurized fluid flows to system alarm 70 via the check valve 121 and piping connected to medial port 28*a* and the alarm 70 is triggered. The upper drain subassembly 125 and the lower drain subassembly 124 are respectively connected to ports 28*b* and 28*c* to facilitate the draining of the fire system piping after use so that the fire system can be set to the stand-by state. In addition, alarm drain subassembly 123 first can be connected to the medial port 28*a* to drain the neutral chamber 27. Further, port 28*d* can be used for systems that use supervisory air in dry sprinkler systems. For example, the automatic control device or module 80 of the appropriate trim configurations that use supervisory air can connect to port 28*d*. As seen in FIG. 1B, the orientation of the ports 28*a*, 28*b*, 28*c* and 28*e* are such that the corresponding subassemblies 121, 122, 123, 124 and 125 are preferably oriented and disposed substantially parallel to the second plane P2 and perpendicular to the first plane P1 (see FIGS. 2A and 2B). The supervisory air subassembly for connecting to port 28*d* can also be preferably oriented and disposed substantially parallel to the second plane P2 and perpendicular to the first plane P1. The orientation of the ports 28*a-e* in exemplary embodiments of the control valve 20 allows the control valve 20 to be mounted in close proximity to a wall.

The embodiment of FIGS. 1A-1C represents a base control valve and valve actuator assembly configuration with a manual release valve. The embodiment of FIGS. 1A-1C does not include an automatic control device or module 80 for automatically triggering (or opening) the control valve 20. However, the embodiment of FIGS. 1A-1C can be used with any one of a number of trim configurations, which include automatic control device or module 80, by merely connecting the automatic control device or module 80 of the trim configuration to the second port 36*b* of the valve actuator 30. The automatic control device or module 80 preferably provides for an automatic trip response of the valve actuator 30 by preferably automatically draining fluid pressure from the internal chamber 34 in response to detection of a fire or other condition to so as to place the valve actuator 30 in an actuated state. In one embodiment of the valve actuator assembly 10, the second port 36*b* of the valve actuator 30 can be coupled to a wet pilot sprinkler system (not show). The fluid pressure in the wet pilot sprinkler system maintains the valve actuator 30 in a ready-state. For example, the fluid pressure from the wet pilot sprinkler system keeps the sealing member 35 engaged with the first actuator seat 33*a* and the second actuator seat 33*b*. When the wet pilot sprinklers operate in response to a fire and fluid pressure in the wet pilot sprinkler system is released, the reduced fluid pressure permits the valve actuator 30 to trip and operate to its actuated state. For example, the biasing force from the at least one biasing member 45 forces the sealing member 35 to the open position. The following describes various trim modules that can be used with the embodiment of FIGS. 1A-1C.

Shown in FIG. 4 is a preferred double interlock trim module 80*a*, which preferably includes a dry pilot actuator 82, a low pressure switch 84, a pressure gauge 86 and a preferably normally closed electronically operated solenoid valve 88 interconnected by appropriate piping and fittings for connection to the base valve and valve actuator assembly 10. In particular, the preferred double interlock trim module 80*a* can include a first connection 81*a* for coupling the electronically operated solenoid valve 88 to the second port 36*b* preferably via a T-connection 41 which is also connected to the manual release device 50, a second connection 83 (see FIG. 7A) for coupling the low pressure switch 84 to preferably a compressed gas supply (not shown), a third connection for coupling to a dry sprinkler system piping, e.g., via port 28*d* on control valve 20, and a drain line or port 87 for placing the dry pilot actuator in fluid communication with the drip funnel 60 and associated drain line. The electronic solenoid valve 88 is preferably configured for interconnection with an electronic detection system, such as for example, a heat or smoke detector and/or an associated releasing panel. FIG. 4 shows the preferred integrated fluid control valve and valve actuator assembly 10*a* with the preferred double interlock trim module 80*a* connected to the second actuator port 36*h*.

Shown in FIG. 5 is a preferred pneumatic trim module 80*b*, which preferably includes a dry pilot actuator 82, a pressure gauge 86 and a low pressure switch 84, interconnected by appropriate piping and fittings for connection to the base valve and valve actuator assembly 10. In particular, the preferred pneumatic trim module 80*b* can include a first connection 81*b* for coupling the dry pilot actuator 82 to the second port 36*b* preferably via a T-connection 41 which is also connected to the manual release device 50, a second connection 83 for coupling the dry pilot actuator 82 and low pressure switch 84 to preferably a compressed gas supply (not shown), a third connection for coupling to a dry sprinkler system and/or a dry pilot sprinkler system piping, e.g., via port 28*d* on control valve 20, and a drain line or port 87 for placing the dry pilot actuator in fluid communication with the drip funnel 60 and associated drain line. FIG. 5 shows the preferred integrated fluid control valve and valve actuator assembly 10*b* with the preferred pneumatic trim module 80*b* connected to the second actuator port 36*b*.

Shown in FIG. 6 is a preferred electric trim module 80*c*, which preferably includes a preferably normally closed electronically operated solenoid valve 88 interconnected by appropriate piping and fittings for connection to the base valve and valve actuator assembly 10. In particular, the preferred electric trim module 80*c* can include a connection for coupling the electronically operated solenoid valve 88 to the second port 36*b* preferably via a T-connection 41 which is also connected to the manual release device 50, and a drain line or port 87 for placing the solenoid valve 88 in fluid communication with the drip funnel 60 and associated drain line. As shown in FIG. 6, the orientation of the T-connection 41 is disposed transverse to the flow axis of the control valve 20. However, the orientation of the T-connection 41 can be parallel to the flow axis of the control valve 20, depending on, e.g., desired flow characteristics and available space. The electronic solenoid valve 88 is preferably configured for interconnection with an electronic detection system, such as for example, a heat or smoke detector and/or an associated releasing panel. FIG. 6 shows the preferred integrated fluid control valve and valve actuator assembly 10*c* with the preferred electric trim module 80*c* connected to the second actuator port 36*b*.

Figure 7A:
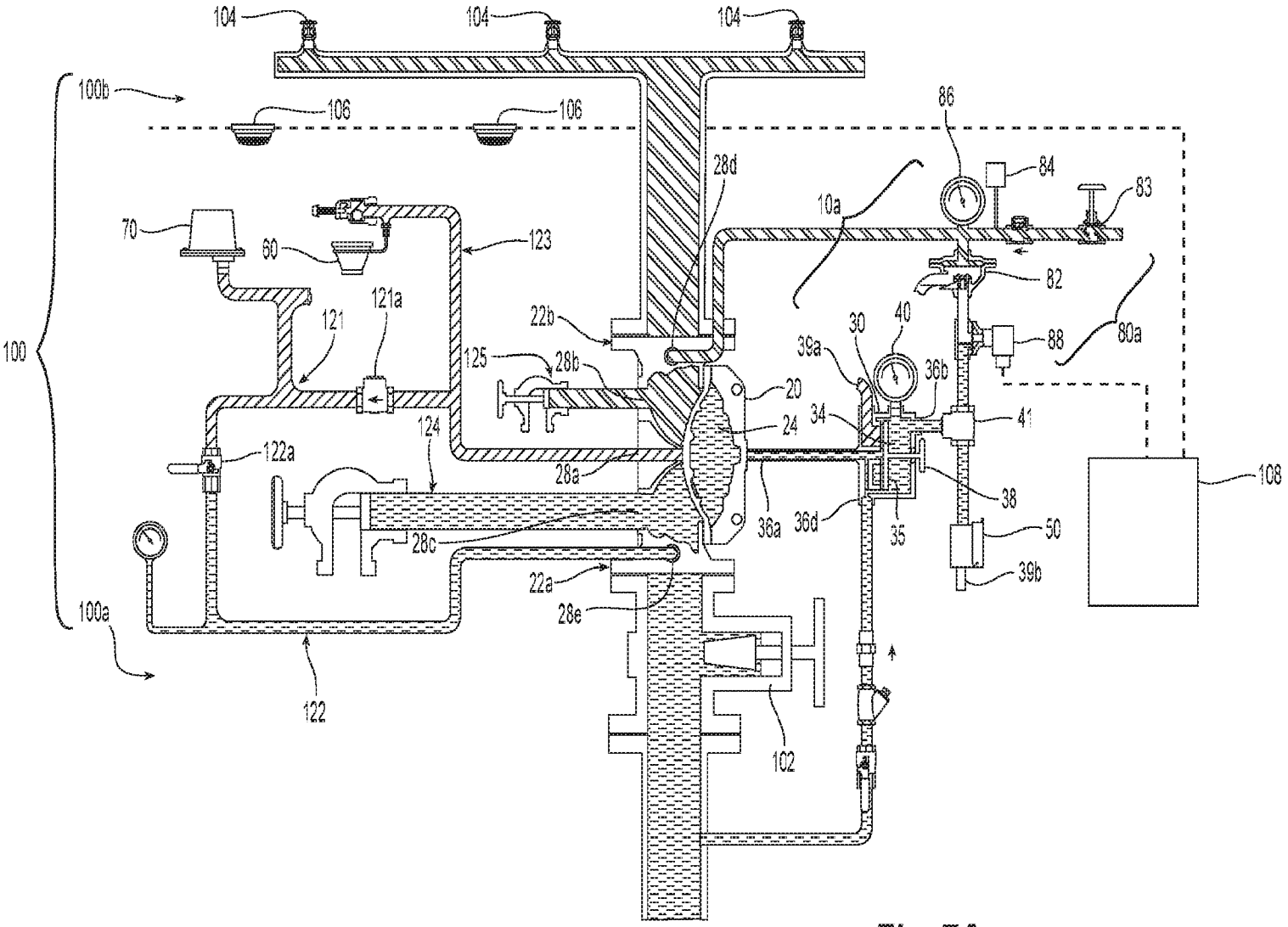
FIG. 7A is a schematic system diagram of a preferred fire protection system in an unactuated ready state with the assembly of FIG. 4.
Figure 7B:
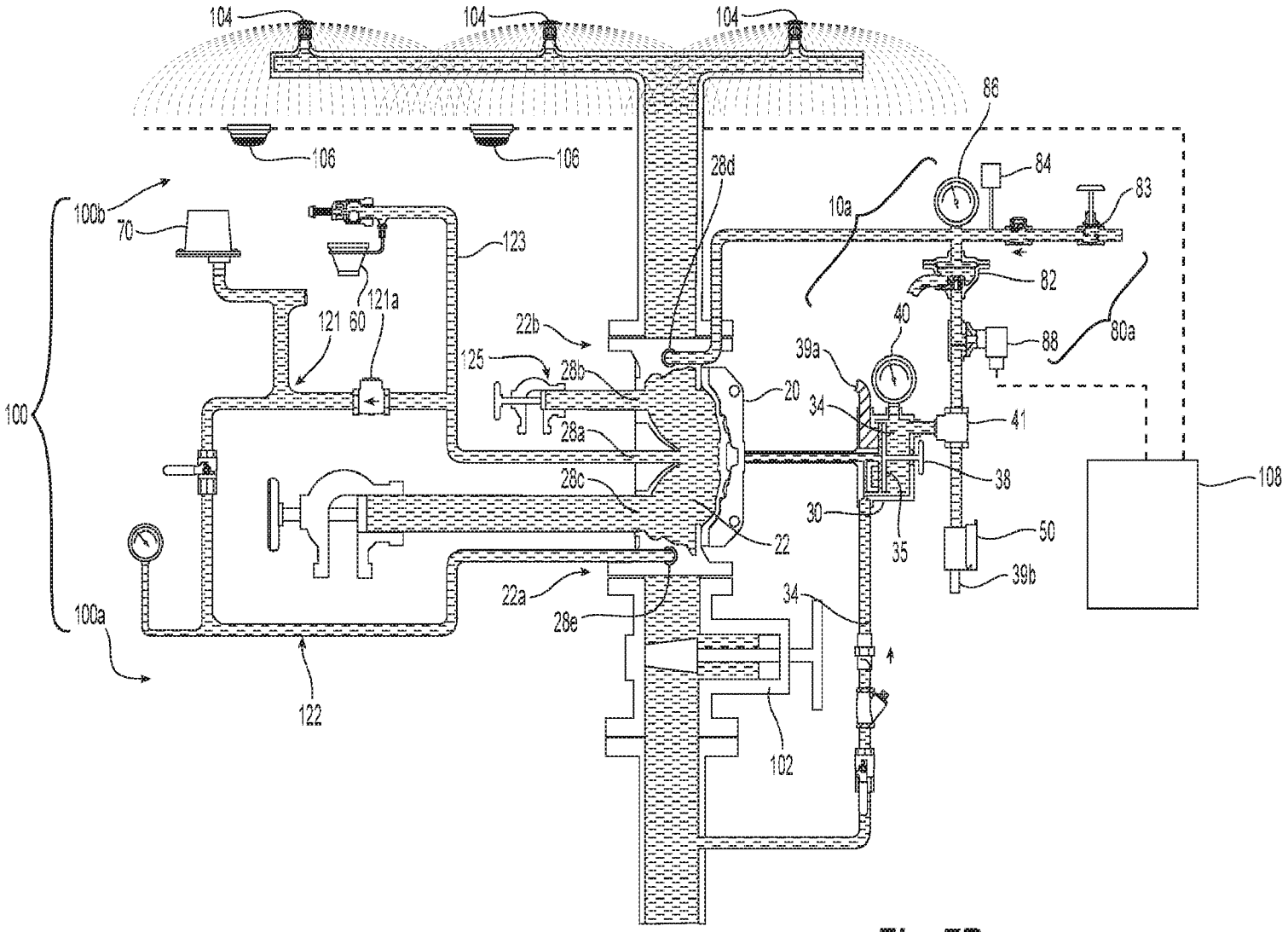
FIG. 7B is a schematic system diagram of the fire protection system of FIG. 7A in an actuated open state.

The preferred valve actuator 30 preferably provides for automatic and manual actuation of a control valve 20, e.g., via port 36*b*, and for resetting the control valve 20 to a stand-by state. Moreover, preferred operation of the valve actuator 30 sets, operates and controls the control valve 20 for placing a fire protection system in an unactuated ready-state and operating the fire protection system to address a fire. With reference to FIGS. 7A-7B, shown are respective schematic views of the fire protection system 100 in an unactuated ready-state and an actuated operated state. As shown the fire protection system 100 includes a liquid supply piping system 100*a* for supplying a liquid, such as for example water to a sprinkler piping system 100*b* coupled together by a preferred embodiment of a preferably integrated fluid control valve and valve actuator assembly 10 described herein. The fire protection sprinkler piping system 100 shown in FIGS. 7A and 7B is an illustrative embodiment of a double-interlock preaction sprinkler system in which the sprinkler system employs automatic sprinklers 104 attached to a piping system 100*b* that contains air or other compressed gas under pressure with a supplemental detection system. The illustrated detection system includes one or more detectors 106 for detecting a fire, such as a smoke or heat detector 106 installed in the same area as the sprinklers 104. The detectors 106 are preferably interconnected with the electronic solenoid valve 88 of the preferred automatic control device or module 80*a* by the releasing panel 108 to operate the normally closed electronic solenoid valve 88 in response to a detection by the detectors 106. A second detection system includes a low air detection system which can detect an open or actuated sprinkler 104. The dry pilot actuator 82 of the preferred automatic control device or module 80*a* can act as the low air detector by operation upon detection of a low air threshold. For the double-interlock preaction system shown, the preferred control valve and valve actuator assembly 10*a* operates from its ready or stand-by state to admit water to the sprinkler protection system 100*b* upon operation of both detectors 106, 82, the preferred automatic control device or module 80*a* and the preferred valve actuator 30.

Again, the preferred valve actuator 30 preferably provides for automatic and manual actuation of a control valve 20, e.g., via port 36*b*, and for resetting the control valve 20 to a stand-by state. More specifically, with reference to FIGS.

2A-2B, 3A in combination with FIGS. 7A-7B, a preferred method of operating the valve actuator 30 preferably includes establishing the stand-by state of the valve actuator 30 by locating the sealing member 35 against the preferred actuator seats 33*a*, 33*b* and providing fluid pressure from the preferred common or fourth port 36*d* to the chamber 34 on a first side of the sealing member 35 and to a port on the second side of the sealing member 35. In one preferred embodiment of the method, the sprinkler system piping 100*b* is drained of water or otherwise dry with the preferably automatic fire protection sprinklers 104 in an unactuated state. A compressed gas, such as for example compressed air is preferably delivered through the preferred double interlock trim module 80*a* via the connection 83. The trim module 80*a* is preferably connected at least one of a medial port 28*h*, 28*d* of the fluid control valve for filling the sprinkler piping 100*b* with the compressed gas. The compressed gas pressure is permitted to close the dry pilot actuator 82 and the electronically operated solenoid valve 88 is returned to its normally closed position.

To reset the preferred control valve and valve actuator assembly 10*a*, water from the liquid supply piping system 100*a* is delivered to the first port 36*a* and the internal chamber 34 of the preferred actuator 30 and to the valve chamber 24 of the fluid control valve 20 via the common or fourth port 36*d*. To reset the valve diaphragm 26 of the preferred fluid control valve 20 in its sealed position, the preferred manual reset 38 is preferably depressed or operated to seat the seal member 35 in its sealed position against the first and second actuator seats 33*a*, 33*b*. The increase in the fluid pressure in the valve chamber 24 acts on the valve diaphragm 26 to its sealed position thereby closing the fluid port 22 and the fluid communication between the fluid system piping 100*a* and the sprinkler system piping 100*b* to permit the compressed air to come up to its stand-by pressure in the sprinkler piping system 100*b*. The preferred main water control valve 102 is opened to deliver water the inlet 22*a* of the fluid control valve and the main drain valve is closed and the liquid piping system 100*a* is brought up to its stand-by pressure to place the system 100 and the preferred control valve and valve actuator assembly 10*a* in ready or stand-by-state.

With the preferred system in its ready-state, the system is ready to address a fire. For the preferred double-interlock system, the preferred heat or smoke detectors 106 are coupled to a releasing panel 108, which is coupled to the preferred electronic solenoid valve 88. In the presence of a sufficient level or heat or smoke, the normally open solenoid valve 88 opens. In addition, in the presence of a sufficient level of heat, one or more of the sprinklers 104 actuates to release compressed gas pressure from the sprinkler piping system 100*b*. The reduction in compressed gas pressure in the piping system 100*b* preferably trips or opens the dry pilot actuator 82. When both the solenoid valve 88 and dry pilot actuator 82 have actuated, the fluid pressure is released from the seal member 35 in the valve actuator 30 permitting it to move, trip or operate from its sealed position to its open position thereby placing the valve chamber 24 in fluid communication with the internal valve chamber 34 via port 36*a*. The fluid in the internal chamber 34 is permitted to drain out of the preferred trim module 80*a* at a greater rate than is supplied to the internal chamber 34 via the common supply port 36*d*. Accordingly, the seal member 35 of the actuator 30 moves to its open position and the fluid pressure in the valve chamber 24 is reduced as fluid is discharged from the valve chamber 24 and out a drain of the preferred trim module 80*a* and the drain line 39*a* from third port 36*c* of the actuator 30. With the reduced fluid pressure in the valve chamber 24, the valve diaphragm 26 moves from its sealed position to its open position to open the internal flow port 22 and place the liquid supply piping system 100*a* in fluid communication with the sprinkler piping system 100*b*. Water is permitted to fill the sprinkler piping system 100*b* and discharge from the actuated sprinklers 104 to address a fire. Water flowing through the open internal port 22 of the fluid control valve 20 preferably also discharges out of the medial port 28*a* and the neutral chamber 27 to sound the alarm system coupled thereto.

Control and operation of the preferred control valve and actuator assembly 10 can be alternatively configured by changing the automatic control device coupled to the second port 36*b* of the valve actuator 30. In particular trim components can be reduced by coupling any one of the pneumatic or electric trim assembly 80*b*, 80*c* previously described. The pneumatic or electric trim assemblies 80*b*, 80*c* provide for a single interlock to operate or trip the valve actuator 30 and open the fluid control valve 20 in a manner as described. For the pneumatic trim module 80*b*, the dry pilot actuator detects low pressure in the pressurized sprinkler piping, indicative of a sprinkler 104 actuation, and in response operates to operate the valve actuator 30. The electric trim module 80*c*, upon receipt of a detection signal from the heat/smoke detectors 106 preferably via the releasing panel 108, opens from its normally closed position to operate the valve actuator 30.

The system 100 can be further altered by altering the sprinkler piping system to be either a sprinkler piping system in which the sprinklers 104 are always open. For such a system, the automatic control device coupled to the second port 36*b* of the valve actuator 30 can be any one of a wet pilot or dry pilot sprinkler system. In such system, the actuation of the pilot sprinklers relieves fluid pressure on the seal member 35 of the valve actuator permitting it to trip and operate in a manner as previously described. In the case of the wet pilot system, the pilot system is preferably directly coupled to a port of the T-connection 41 connected to the second port 36*b* of the valve actuator 30. For a dry pilot actuator sprinkler system, the system is preferably coupled to a port of the T-connection 41 connected to the second port 36*b* of the valve actuator 30 by the pneumatic trim module 80*b*. In another alternate embodiment in which the sprinklers 104 of the sprinkler piping system are always open, operation of the fluid control valve and valve actuator assembly 10*c* can be interlocked by preferably coupling the electronic trim module 80*c* to the second port 36*b* of the valve actuator 30, with an interconnection to appropriate fire heat/smoke detectors 106, to control the automatic operation of the valve actuator 30 in a manner as previously described. In the above embodiments, a manual release device can be connected to the port 36*b* to manually operate the fire suppression system. Preferably, the manual device is attached to port 36*b* in parallel with the automatic control devices discussed above, preferably via a T-connection 41, such that actuating either the manual release device or the automatic control device will actuate the fire suppression system.

While the present invention has been disclosed with reference to certain embodiments, numerous modifications, alterations, and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What is claimed is:

1. A valve actuator, comprising:

a housing defining an internal chamber;

a first port in communication with the internal chamber and extending along an axis that extends through the internal chamber, the first port to connect with a fluid control valve;

a second port in communication with the internal chamber, the second port to connect with at least one of an automatic control device and a manual release device;

a third port in communication with the internal chamber, the third port provides a drain for the internal chamber;

a fourth port in communication with the internal chamber, the fourth port to connect with a fluid supply to provide fluid to the internal chamber;

a seal positioned in the internal chamber of the housing, the seal operates responsive to fluid flow through the second port to permit fluid flow out of the fluid control valve through the first port to drain from the third port to trigger operation of the fluid control valve; and a manual reset actuator to reset the seal to a sealed position, the manual reset actuator aligned with the axis.

2. The valve actuator of claim 1, comprising:

the seal operates by moving from a sealed position in which the seal is engaged with an actuator seat of the housing to an open position in which the seal is spaced from the actuator seat.

3. The valve actuator of claim 1, comprising:

the fourth port has a first bore that provides fluid communication with the first port and a second bore that provides fluid communication with the internal chamber, the first bore having a larger diameter than the second bore.

4. The valve actuator of claim 1, comprising:

a fifth port connected with the internal chamber, the fifth port to provide fluid communication with a pressure gauge.

5. The valve actuator of claim 1, comprising:

a joint that provides a common connection between the second port and the manual release device and the automatic control device to allow fluid to flow out of the internal chamber through the joint responsive to operation of the manual release device or the automatic control device.

6. The valve actuator of claim 1, comprising:

the valve actuator operates as part of at least one of a wet pilot actuation system, dry pilot actuation system, electric actuation system, and a pneumatic action system.

7. The valve actuator of claim 1, comprising:

the seal operates by moving from a sealed position to an open position responsive to a change in a pressure differential across the seal.

8. The valve actuator of claim 1, comprising:

the first port, second port, third port, and fourth port are each formed by the housing.

9. A valve actuator, comprising:

a housing defining an internal chamber;

a first port in communication with the internal chamber;

a second port in communication with the internal chamber;

a third port in communication with the internal chamber;

a fourth port in communication with the internal chamber;

a seal positioned in the housing, the seal operates responsive to fluid flow through the second port to permit fluid flow through the first port to drain from the third port; and at least one biasing member to bias the seal in an open position in which the seal is spaced from an actuator seat positioned in the internal chamber.

* * * * *